US011434712B2

(12) United States Patent
Taylor, Jr.

(10) Patent No.: US 11,434,712 B2
(45) Date of Patent: Sep. 6, 2022

(54) WHIPSTOCK ASSEMBLY FOR FORMING A WINDOW

(71) Applicant: Weatherford Technology Holdings, LLC, Houston, TX (US)

(72) Inventor: James H. Taylor, Jr., Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 30 days.

(21) Appl. No.: 15/953,988

(22) Filed: Apr. 16, 2018

(65) Prior Publication Data

US 2019/0316435 A1 Oct. 17, 2019

(51) Int. Cl.
*E21B 29/06* (2006.01)
*E21B 33/12* (2006.01)
*E21B 23/01* (2006.01)

(52) U.S. Cl.
CPC ..... *E21B 29/06* (2013.01); *E21B 23/01* (2013.01); *E21B 33/12* (2013.01)

(58) Field of Classification Search
CPC ..... E21B 23/01; E21B 29/06; E21B 33/12; E21B 7/06; E21B 7/061; E21B 7/062; E21B 7/067
See application file for complete search history.

(56) References Cited

U.S. PATENT DOCUMENTS 2,338,788 A 1/1944 Walker
2,509,144 A 5/1950 Grable et al.
3,343,615 A 9/1967 Terry
4,266,621 A 5/1981 Brock
4,285,399 A 8/1981 Holland et al.
4,397,360 A 8/1983 Schmidt
5,113,938 A 5/1992 Clayton
5,277,251 A 1/1994 Blount et al.
5,341,873 A 8/1994 Carter et al.
5,353,876 A 10/1994 Curington et al.
5,425,419 A 6/1995 Sieber
5,437,340 A 8/1995 Lee et al.
5,445,222 A 8/1995 Pritchard et al.
5,474,126 A * 12/1995 Lynde ..... E21B 7/061 166/117.6
5,488,989 A 2/1996 Leising et al.
5,522,461 A * 6/1996 Carter ..... E21B 44/005 166/298
5,531,271 A 7/1996 Carter
5,551,509 A 9/1996 Braddick
5,657,820 A 8/1997 Bailey et al.
5,769,166 A 6/1998 Duke
5,806,600 A 9/1998 Halford, Sr.
(Continued)

FOREIGN PATENT DOCUMENTS

WO 03087524 A1 10/2003

OTHER PUBLICATIONS

United Kingdom Combined Search and Examination Report dated May 21, 2019, for Application No. GB1903427.1.

*Primary Examiner* — Christopher J Sebesta
(74) *Attorney, Agent, or Firm* — Patterson + Sheridan, LLP

(57) ABSTRACT

A whipstock assembly includes an inner body having a bore and an inclined surface at an upper portion; and an outer body disposed around the inner body and releasably attached to the inner body, the outer body having an inclined surface and an upper portion closed to fluid communication.

21 Claims, 18 Drawing Sheets

(56) References Cited

U.S. PATENT DOCUMENTS

| | | | | |
|---|---|---|---|---|
| 5,813,465 | A | 9/1998 | Terrell et al. | |
| 5,887,655 | A | 3/1999 | Haugen et al. | |
| 5,894,889 | A | 4/1999 | Dewey et al. | |
| 6,012,516 | A | 1/2000 | Brunet | |
| 6,019,173 | A | 2/2000 | Saurer et al. | |
| 6,024,169 | A | 2/2000 | Haugen | |
| 6,056,056 | A | 5/2000 | Durst et al. | |
| 6,092,593 | A | 7/2000 | Williamson et al. | |
| 6,092,601 | A | 7/2000 | Gano et al. | |
| 6,125,937 | A | 10/2000 | Longbottom et al. | |
| 6,138,756 | A | 10/2000 | Dale | |
| 6,283,208 | B1 | 9/2001 | George et al. | |
| 6,315,044 | B1 | 11/2001 | Tinker | |
| 6,332,498 | B1 | 12/2001 | George | |
| 6,401,821 | B1 * | 6/2002 | Kennedy | E21B 29/06 166/313 |
| 6,457,525 | B1 | 10/2002 | Scott | |
| 6,591,905 | B2 | 7/2003 | Coon | |
| 6,708,769 | B2 | 3/2004 | Haugen et al. | |
| 6,719,045 | B2 | 4/2004 | Hart et al. | |
| 6,766,859 | B2 | 7/2004 | Haugen et al. | |
| 6,968,896 | B2 | 11/2005 | Coon | |
| 6,968,903 | B2 | 11/2005 | Pollard | |
| 8,245,774 | B2 | 8/2012 | Carter et al. | |
| 9,416,638 | B2 | 8/2016 | Zhou | |
| 2002/0070018 | A1 | 6/2002 | Buyaert | |
| 2002/0079102 | A1 | 6/2002 | Dewey et al. | |
| 2003/0102129 | A1 * | 6/2003 | Dewey | E21B 7/061 166/298 |
| 2003/0196819 | A1 | 10/2003 | Coon | |
| 2005/0257930 | A1 | 11/2005 | Carter, Jr. et al. | |
| 2008/0185148 | A1 * | 8/2008 | Carter | E21B 17/1007 166/298 |
| 2013/0025864 | A1 * | 1/2013 | Robin | E21B 7/061 166/298 |
| 2013/0284458 | A1 * | 10/2013 | Dancer | E21B 29/06 166/380 |
| 2015/0369022 | A1 | 12/2015 | Zhou | |
| 2016/0145956 | A1 * | 5/2016 | Dahl | E21B 7/061 166/382 |

* cited by examiner

WHIPSTOCK ASSEMBLY FOR FORMING A WINDOW

BACKGROUND

Field

Embodiments of the present disclosure relate to sidetrack drilling for hydrocarbons. In particular, this disclosure relates to a whipstock assembly for creating a window within a wellbore casing. More particularly still, this disclosure relates to a whipstock assembly having a removable sleeve for re-establishing fluid communication with wellbore.

Description of the Related Art

In recent years, technology has been developed which allows an operator to drill a primary vertical well, and then continue drilling an angled lateral borehole off of that vertical well at a chosen depth. Generally, the vertical, or "parent" wellbore is first drilled and then supported with strings of casing. The strings of casing are cemented into the formation by the extrusion of cement into the annular regions between the strings of casing and the surrounding formation. The combination of cement and casing strengthens the wellbore and facilitates the isolation of certain areas of the formation behind the casing for the production of hydrocarbons.

In many instances, the parent wellbore is completed at a first depth, and is produced for a given period of time. Production may be obtained from various zones by perforating the casing string. At a later time, it may be desirable to drill a new "sidetrack" wellbore utilizing the casing of the parent wellbore. In this instance, a tool known as a whipstock is positioned in the casing at the depth where deflection is desired, typically at or above one or more producing zones. The whipstock is used to divert milling bits into a side of the casing in order create an elongated elliptical window in the parent casing. Thereafter, a drill bit is run into the parent wellbore. The drill bit is deflected against the whipstock, and urged through the newly formed window. From there, the drill bit contacts the rock formation in order to form a new lateral hole in a desired direction. This process is sometimes referred to as sidetrack drilling.

When forming the window through the casing, an anchor is first set in the parent wellbore at a desired depth. The anchor is typically a packer having slips and seals. The anchor tool acts as a fixed body against which tools above it may be urged to activate different tool functions. The anchor tool typically has a key or other orientation-indicating member.

A whipstock is next run into the wellbore. The whipstock has a body that lands into or onto the anchor. A stinger is located at the bottom of the whipstock which engages the anchor device. At a top end of the body, the whipstock includes a deflection portion having a concave face. The stinger at the bottom of the whipstock body allows the concave face of the whipstock to be properly oriented so as to direct the milling operation. The deflection portion receives the milling bits as they are urged downhole. In this way, the respective milling bits are directed against the surrounding tubular casing for cutting the window.

In order to form the window, a milling bit, or "mill," is placed at the end of a string of drill pipe or other working string. In some milling operations, a series of mills is run into the hole. First, a starting mill is run into the hole.

Rotation of the string with the starting mill rotates the mill, causing a portion of the casing to be removed. This mill is followed by other mills, which complete the creation of the elongated window.

In some lateral wellbore completions, it is sometimes desirable to re-establish fluid communication within the parent wellbore with a producing zone at or below the depth of the whipstock. In such an instance, a perforating gun is lowered into the liner for the lateral wellbore. The perforating gun is lowered to the depth of the whipstock, and fired in the direction of the whipstock's deflection portion. The perforations are formed through a perforation plate on the whipstock and the liner of the lateral wellbore. The perforations re-establish fluid communication between the surface and the original producing formation of the parent wellbore. The presence of perforations in the perforation plate allows valuable production fluids to migrate up the parent wellbore from producing zones at or below the level of the whipstock.

To facilitate perforation, it is desirable to have a perforation plate on the whipstock made of a sufficiently thin or pliable metal to permit penetration by the perforating explosives. While such a metal composition aids in perforation of the whipstock, it also reduces the durability of the whipstock during the milling operation and the ability of the whipstock to deflect the mill bits against the casing.

There is, therefore, a need for a whipstock assembly that can be operated to re-establish fluid communication with the wellbore below the whipstock after formation of a window.

BRIEF DESCRIPTION OF THE DRAWINGS

So that the manner in which the above recited features of the present disclosure are attained and can be understood in detail, a more particular description of the disclosure, briefly summarized above, may be had by reference to the drawings that follow. The drawings illustrate only selected embodiments of this disclosure, and are not to be considered limiting of its scope.

DETAILED DESCRIPTION OF THE PREFERRED EMBODIMENT

Figure 1:
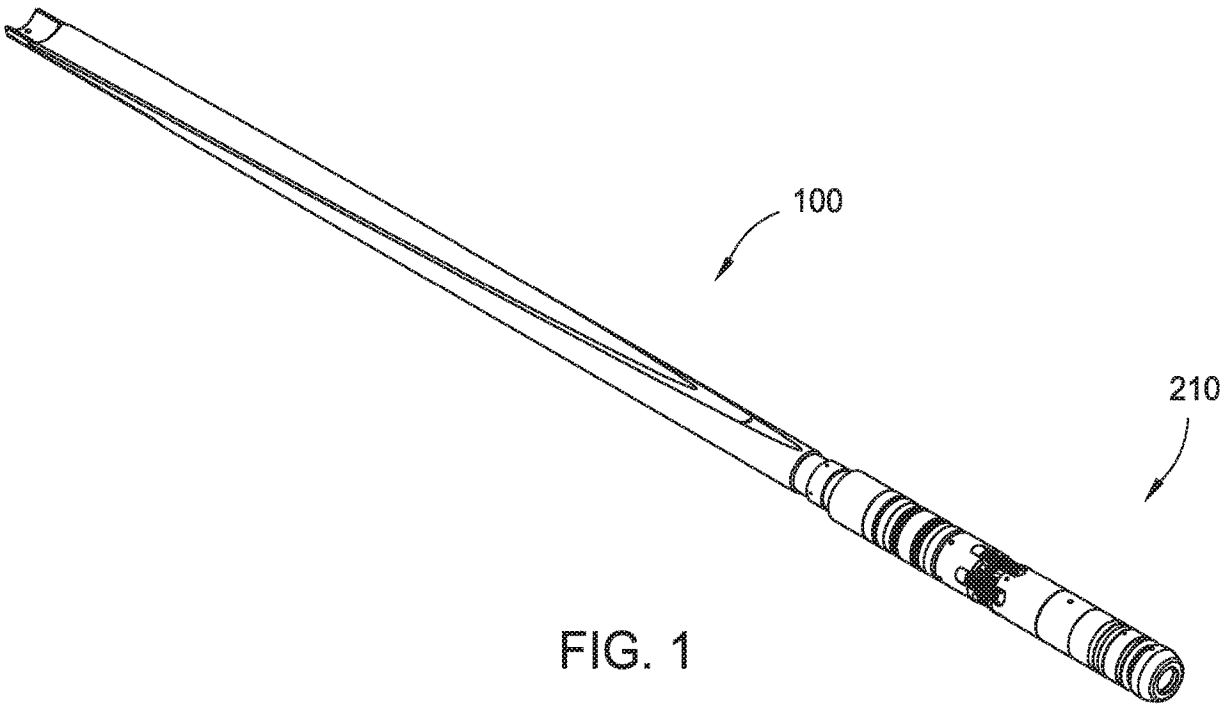
FIG. 1 is a perspective view of one embodiment of a whipstock assembly for milling a window in a wellbore.
Figure 2:
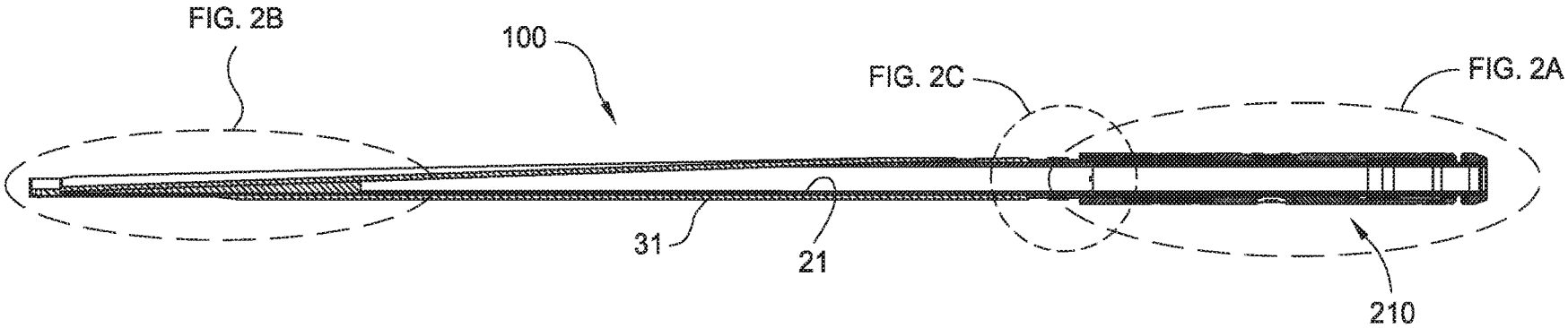
FIG. 2 is a cross-sectional view of the whipstock assembly of FIG. 1.
Figure 2A:
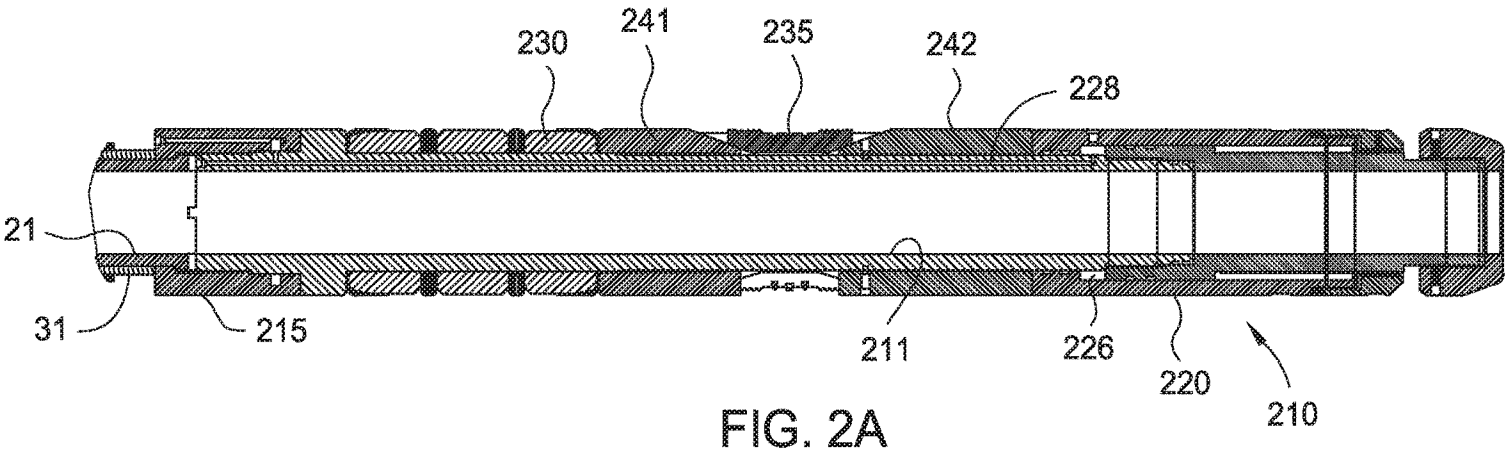
FIGS. 2A, 2B, and 2C are enlarged partial views of the whipstock assembly of FIG. 2.
Figure 2C:
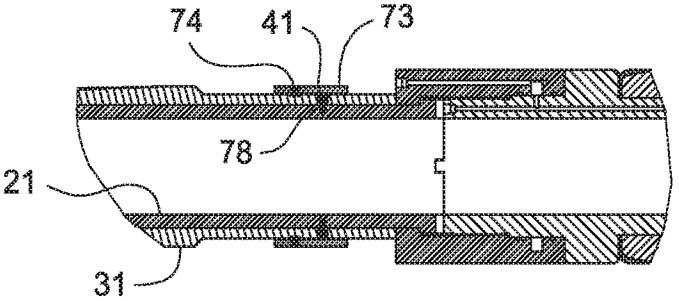
Figure 2B:
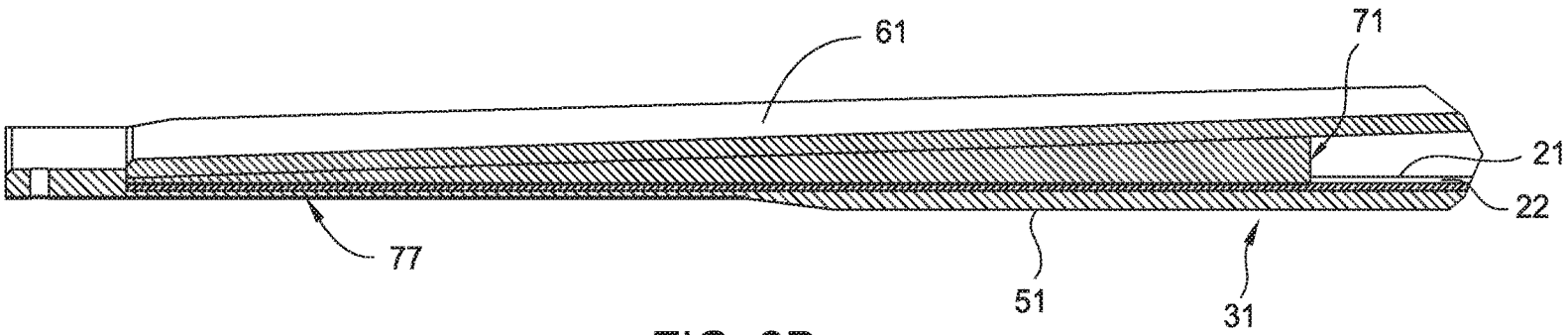
Figure 2E:
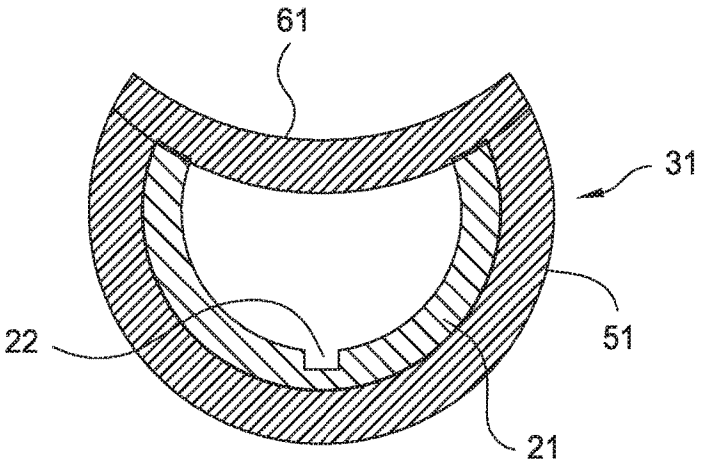
FIGS. 2D, 2E, and 2F are cross-sectional views of different sections of the whipstock assembly of FIG. 2.
Figure 2F:
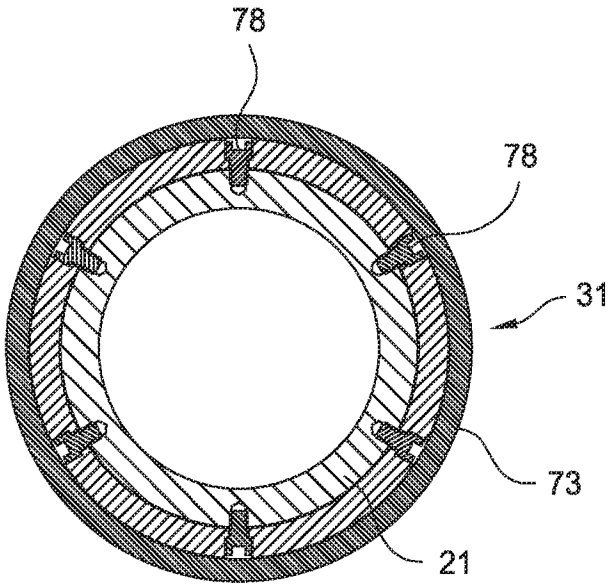
Figure 2D:
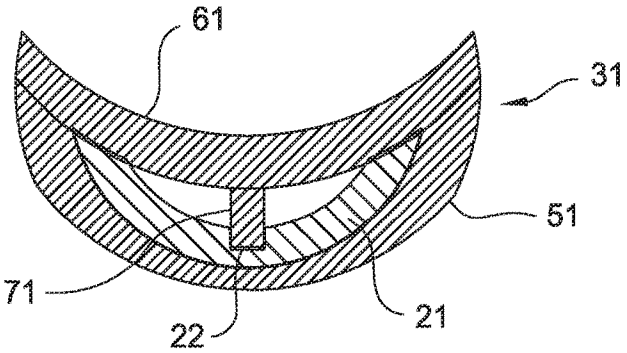

FIG. 1 is a perspective view of one embodiment of the whipstock assembly 100 for milling a window in a wellbore. FIG. 2 is a cross-sectional view of the whipstock 100 of FIG. 1. FIGS. 2A, 2B, and 2C are enlarged partial views of the whipstock 100 of FIG. 2. FIGS. 2D, 2E, and 2F are cross-sectional views of different sections of the whipstock 100 of FIG. 2. The whipstock 100 is shown attached to a packer and anchor assembly 210.

The whipstock 100 has a lower end for connecting to the packer and anchor assembly 210 and a concave shaped upper portion for guiding a drilling member such as a mill bit or a drill bit. In one embodiment, the whipstock 100 includes an outer sleeve body 31 disposed around an inner hollow body 21. As shown in FIG. 2C, the lower end of the outer body 31 is releasably attached to the inner body 21 using a shearable member 41 such as a shear screw. The lower end of the inner body 21 is coupled to the packer and anchor assembly 210 and configured to transfer torque to or from the packer and anchor assembly 210. As shown in FIG. 2B, the upper end of the inner body 21 is disposed within the upper end of the outer body 31.

Figure 3A:
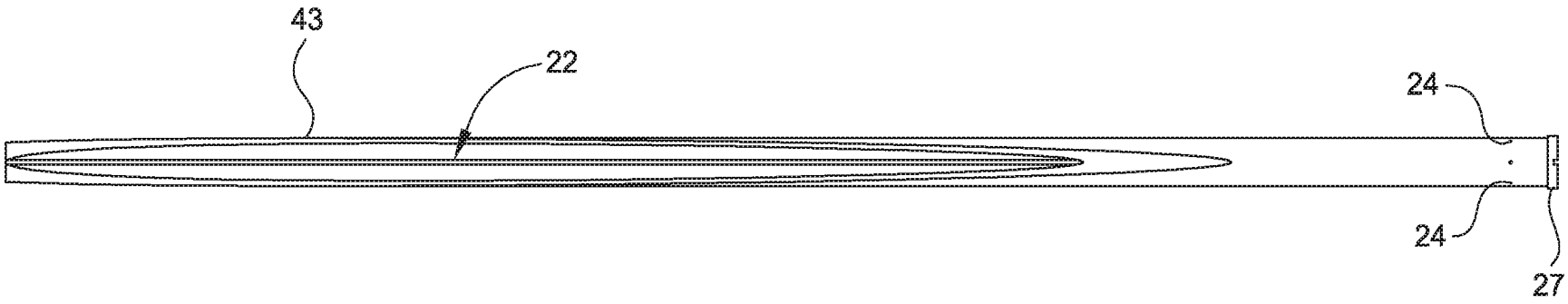
FIG. 3A is a top view of an inner body of the whipstock assembly of FIG. 1, in accordance with one embodiment.
Figure 3C:
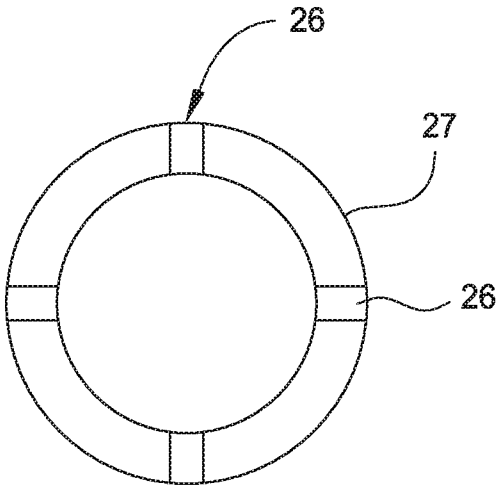
FIG. 3C is a back view of the inner body of FIG. 3A.
Figure 3B:
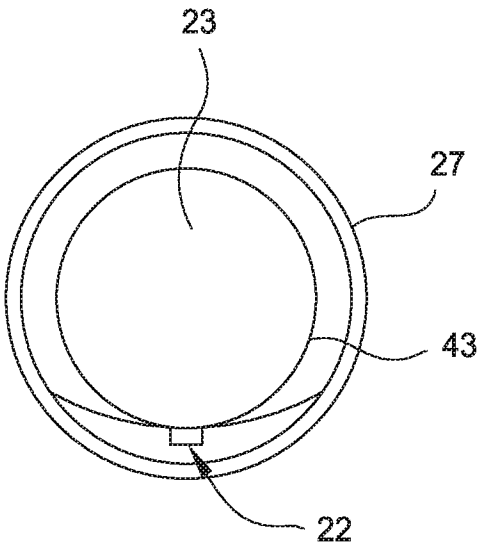
FIG. 3B is a front view of the inner body 21 of FIG. 3A.
Figure 4D:
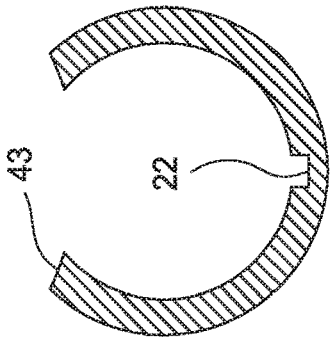
FIGS. 4A, 4B, and 4C are cross-sectional views of different sections of the inner body of FIG. 3A.
Figure 4C:
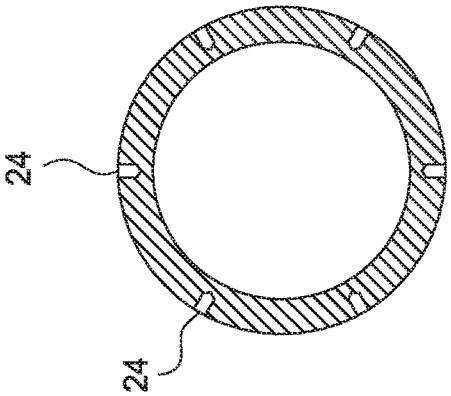
Figure 4B:
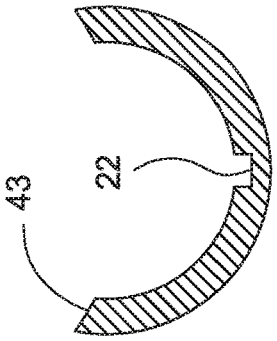
Figure 4A:
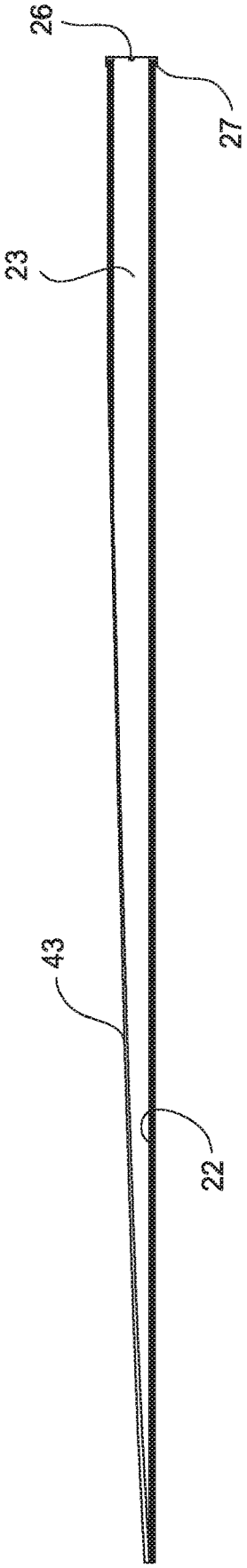

FIG. 3A is a top view of the inner body 21 in accordance with one embodiment. FIG. 3B is a front view of the inner body 21, and FIG. 3C is a back view of the inner body 21. FIGS. 4A, 4B, and 4C are cross-sectional views of different sections of the inner body 21. In one embodiment, the inner body 21 is a tubular having a bore 23 extending therethrough. The upper portion of the inner body 21 has an inclined cut out 43 that exposes the bore 23. The inclined cut out 43 may be achieved using a concave cut on a wall of the inner body 21, as shown in FIGS. 4B and 4D. The inclined cut out 43 may begin at the upper end of the inner body 21 and the inclined cut out 43 extending toward the lower end. In one embodiment, the inclined cut out 43 formed on the upper portion of the inner body 21 may be used as a concave ramp to guide the movement of the mill and set the mill's angle of attack to form the window. In one embodiment, the inclined cut out 43 is between about 2 degrees and 15 degrees; preferably between 2 degrees and 8 degrees; and more preferably between about 2 degrees and 5 degrees.

As shown in FIG. 3A a slot 22 may be formed on an inner surface of the inner body 21 to receive a key from the outer body 31. The slot 22 can also be seen in FIGS. 3B, 4B, and 4D. As shown, the slot 22 is a longitudinal slot that facilitates alignment of the inner body 21 to the outer body 31 and may also prevent relative rotation between the inner body 21 and the outer body 31. In one embodiment, the slot 22 begins at the upper end of the inner body 21, as shown in FIG. 3B. The slot 22 may be between about 75% to 125% of the length of the inclined cut out 43, as shown in FIGS. 3A and 4A. In another embodiment, the slot 22 is between about 5% to 125% of the length of the inclined cut out 43; preferably between about 10% to 80% of the length of the inclined cut out 43; preferably between about 15% to 65% of the length of the inclined cut out 43. The lower end of the inner body 21 may include one or more holes 24 formed on the outer surface for receiving a shearable member, as shown in FIGS. 3A and 4C. While six holes 24 are shown, any suitable number of holes may be formed, such as one, two, three, four, five, seven, eight, or more holes. The bottom of the inner body 21 has an enlarged outer diameter such that a shoulder 27 is formed on the outer surface for engagement with a locking sleeve of the packer and anchor assembly 210. The bottom surface of the inner body 21 may also have one or more lug slots 26 for engagement with torque lugs of the packer and anchor assembly 210. A plurality of lug slots 26 may be circumferentially spaced around the bottom of the inner body 21.

Figure 5A:
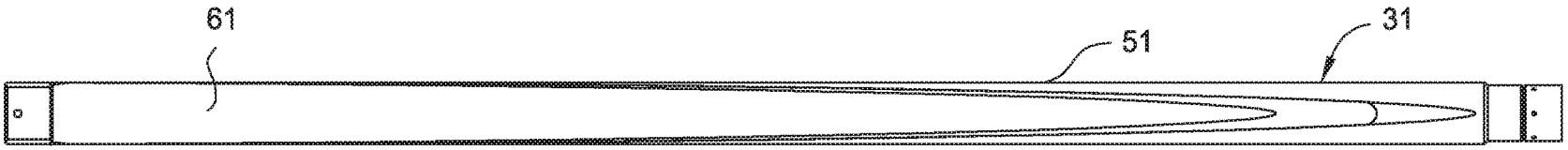
FIGS. 5A and 5B are different perspective views of the outer body of the whipstock assembly of FIG. 1, according to one embodiment.
Figure 5B:
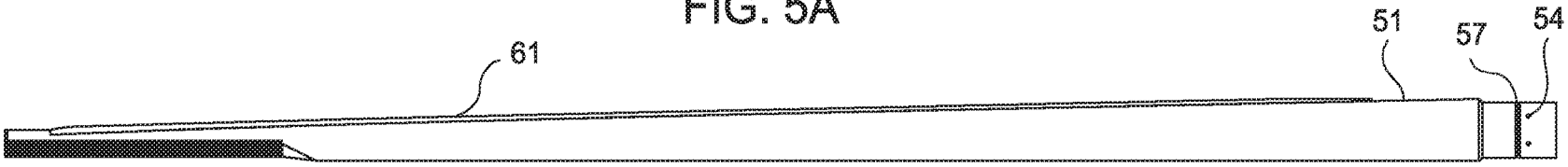
Figure 6A:
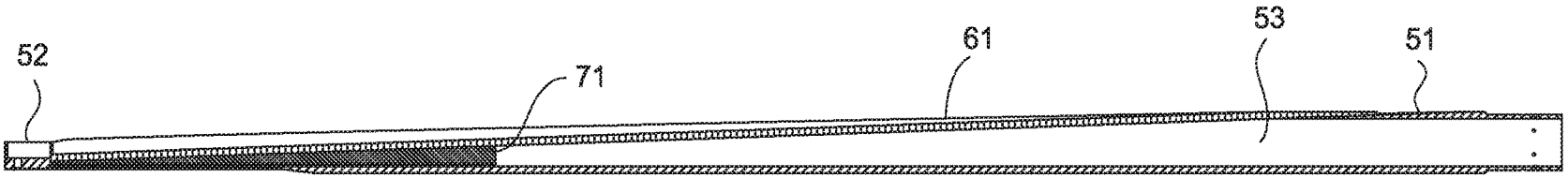
FIGS. 6A-6D are different cross-sectional views of the outer body of FIG. 5A.
Figure 6D:
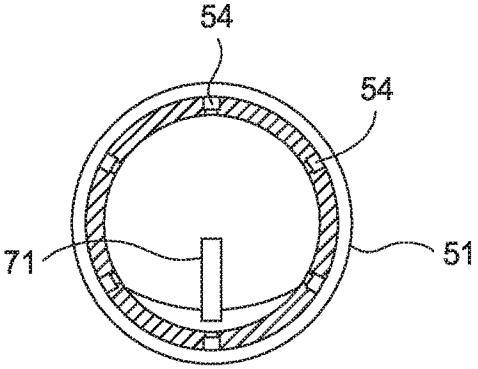
Figure 6C:
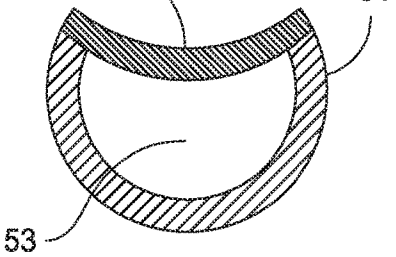
Figure 6B:
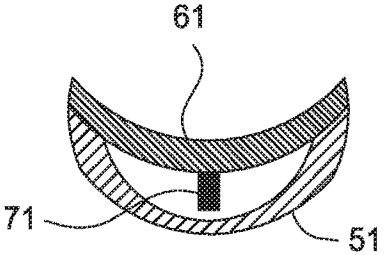
Figures 7A, 7B, 7C, 7D, 7E, 7F, 7G:
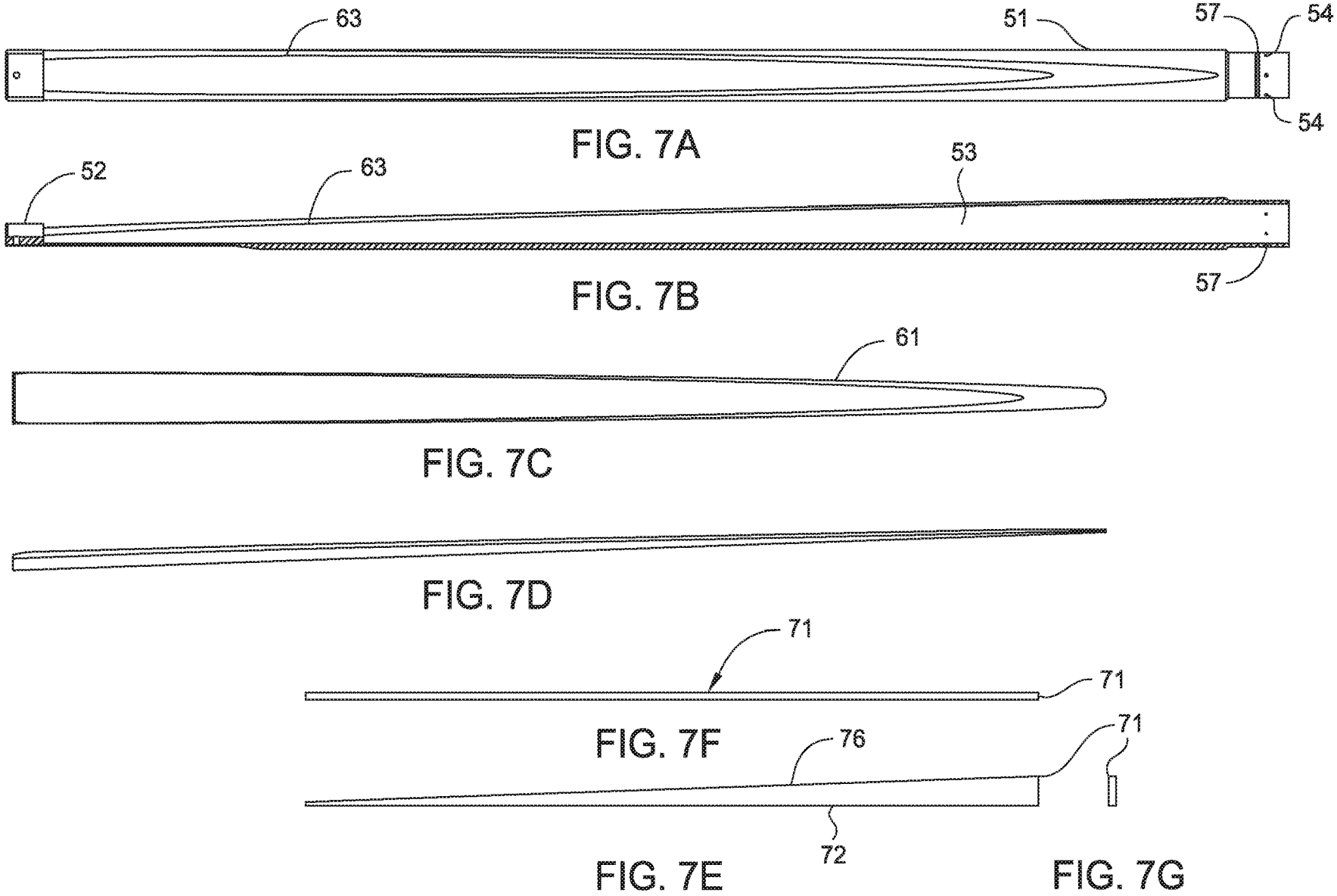
FIGS. 7A and 7B are different perspective views of the outer sleeve of the outer body.
FIGS. 7C and 7D are different perspective views of the concave member of the outer body.
FIGS. 7E-7G are different perspective views of the key of the outer body.

As shown in FIGS. 2B and 2C, the inner body 21 is received in the outer body 31. FIGS. 5A and 5B are different perspective views of the outer body 31, according to one embodiment. FIGS. 6A-6D are different cross-sectional views of the outer body of FIG. 5A. In one embodiment, the outer body 31 includes an outer sleeve 51, a concave member 61, and a guide key 71. FIGS. 7A and 7B are different perspective views of the outer sleeve 51 of the outer body 31, FIGS. 7C and 7D are different perspective views of the concave member 61 of the outer body 31, and FIGS. 7E-7G are different perspective views of the key 71 of the outer body 31. While the outer body 31 is shown as an assembly of the outer sleeve, the concave member, and the key, it is contemplate that one of more of these components may be integral to each other.

In one embodiment, the outer sleeve 51 of the outer body is a tubular having a bore 53 extending therethrough. The upper portion of the outer sleeve 51 has an inclined cut out 63 that exposes the bore 53. The inclined cut out 63 may be achieved using a concave cut, similar to the inner body 21. The inclined cut out 63 may begin near the upper end of the outer sleeve 51 and increases toward the lower end. The inclined cut out 63 may be used to guide the movement of the mill and set the mill's angle of attack to form the window. In one embodiment, the angle of inclined cut out 63 of the outer sleeve 51 is the same as the angle of the inclined cut out 43 of the inner body 21. In one embodiment, the inclined cut out 63 is between about 2 degrees and 15 degrees; preferably between 2 degrees and 8 degrees; and more preferably between about 2 degrees and 5 degrees. The upper end of the outer sleeve 51 may include a connection 52 for connecting to a work string and/or a mill bit or drill bit. The connection 52 may include a hole for receiving a shearable member such as a shear screw. The lower end of the outer sleeve 51 may include one or more holes 54 that can be aligned with the holes 24 of the inner body 21 for receiving a shearable member such as a shear screw. An optional retaining sleeve 73 may be disposed around holes 54 to prevent the shearable members in the holes from falling out or retain the caps of the shearable members after shearing, as shown in FIG. 2C. The retaining sleeve 73 may be attached to the outer sleeve 51 using one or more set screws 74 that engage a circular groove 57 formed on the outer surface of the outer sleeve 51.

The concave member 61 is disposed above and attached to the inclined cut out 63 of the outer sleeve 51. The concave member 61 forms a concave ramp to guide the path of the mill bit. In one embodiment, the concave member 61 extends along the length of the inclined cut out 63, and its width is tapered to complement the inclined cut out 63. As shown in FIG. 7C, the width of the concave member 61 narrows from the upper end to the lower end to complement the inclined cut out 63. As shown in FIGS. 7D, 6B, and 6C, the curvature of the concave member 61 is deeper at the upper end and gradually becomes shallower at the lower end. The concave cut used to form the inclined cut out 63 of the outer sleeve 51 is complementary to the back surface of the concave member 61, as shown in FIGS. 6B and 6C. In one embodiment, the concave member 61 prevents fluid communication through the upper end of the outer body 31. In one embodiment, the concave member 61 is welded to the outer sleeve 51.

In another embodiment, a concave member may be disposed on the inclined cut out of the inner body 21. In this embodiment, the concave member includes one or more openings to allow fluid communication through the concave member.

In one embodiment, the outer body 31 includes a guide member 71 such as a guide key to facilitate alignment of the inner body 21 to the outer body 31. As shown in FIGS. 7E and 6A, the guide key 71 has an inclined top surface 76 that attaches to the bottom surface of the concave member 61. The guide key 71 has a bottom surface 72 for mating with the slot 22 of the inner body 21. In one embodiment, the guide member 71 aligns the inner body 21 to the outer body 31 so that the inclined surface of the inner body 21 directs a downhole tool toward the window formed by the mill bit moving along the inclined surface of the outer body 31. A sufficient clearance is formed between the bottom surface 72 of the guide key 71 and the inner surface of the outer sleeve 51 to receive the inner body 21 and the slot 22. The clearance at the bottom of the guide key 71 can be seen in FIGS. 6A and 6B.

In FIG. 2, the inner body 21 is disposed inside the outer body 31. In FIG. 2C, a plurality of shearable members 78 such as a shear screw are disposed through the holes 24 of the inner body 21 and the holes 54 of the outer sleeve 51. The retaining sleeve 73 covers the shearable members 78 and is coupled to the outer sleeve 51 using a plurality of set screws 75. The shearable connection is also shown in FIG. 2F.

FIG. 2B shows the upper end of the inner body 21 disposed in the outer body 31. The upper end of the inner body 21 is disposed in the clearance between the guide key 71 and the outer sleeve 51. As shown, the guide key 71 is engaged with the slot 22 of the inner body 21. While the slot 22 is longer than the guide key 71, it is contemplated that slot 22 may the same length as the guide key 71. FIG. 2D also shows the inner body 21 inside the outer body 31 and the guide key 71 in the slot 22. FIG. 2E also shows the inner body 21 inside the outer body 31 and the slot 22 of the inner body 21, which implies the slot 22 is longer than the guide key 71.

FIG. 2A illustrates an exemplary embodiment of a packer and anchor assembly 210. The assembly 210 includes a mandrel 211, a locking sleeve 215, an actuating sleeve 220, a sealing element 230, a plurality of slips 235, and wedge members 241, 242. The locking sleeve 215 is configured to lock the inner body 21 to the assembly 210. In one embodiment, the locking sleeve 215 has inwardly facing shoulders for engaging the shoulders 27 of the inner body, as shown in FIG. 2C. The locking sleeve 215 may be threadedly connected to the mandrel 211. The upper end of the mandrel 211 may include one or more lug keys for engaging the lug slots 26 of the inner body 21 to prevent relative rotation therebetween.

The actuating sleeve 220, the sealing element 230, the plurality of slips 235, and the wedge members 241, 242 are disposed on the outer surface of the mandrel 211. The sealing member 230 is positioned between a shoulder of the mandrel 211 and an upper wedge member 241. The slips 235 are disposed between the upper wedge member 241 and the lower wedge member 242. The actuating sleeve 220 is disposed below the lower wedge member 242. An annular chamber 226 is defined between the actuating sleeve 220 and the mandrel 211. One or more seal rings may be used to seal the annular chamber 226. A hydraulic channel 228 through the mandrel 211 may be used to supply hydraulic fluid to the chamber 226. It is contemplated embodiments of the whipstock 100 may be used with any suitable packer, anchor, or a combination of packer and anchor assembly. For example, the anchor may include a plurality of slips disposed on a mandrel having a bore. The packer may include a sealing element disposed on a mandrel having a bore.

In operation, whipstock 100 is assembled with the packer and anchor assembly 210. A mill is attached to the upper end of the whipstock 100 such as via the connection 52 of the outer body 31. For example, the mill can be releasably attached to the connection using a shearable lug or screw. The whipstock 100 is lowered into the wellbore using a workstring. After reaching the location of the window to be formed, the packer and anchor assembly 210 is set below the window. Hydraulic is supplied to the chamber 226 to urge the actuating sleeve 220 upward, thereby moving the lower wedge member 242 closer to the upper wedge member 241. As a result, the slips 235 are urged up the inclined of the wedge members and outwardly into engagement with the surround casing. After setting the slips 235, weight is set down on the whipstock 100, thereby compressing the sealing element 230 between the shoulder of the mandrel 211 and the upper wedge member 241. The sealing element 230 is urged outwardly into engagement with the surrounding casing to seal off fluid communication through the annulus. Although the bore of the inner body 21 is open to fluid pressure from below the sealing element 230, the outer body 31 closes communication through the bore of the inner body 21.

Additional pressure is applied to the mill to release the mill from the whipstock. For example, sufficient pressure is applied from the surface to break the shearable lug or screw connecting the mill to the whipstock. The mill is then urged along the concave member 61 of the whipstock 100, which deflects the mill outward into engagement with the casing.

After the window is formed, the mill is retrieved. A retrieval tool is lowered into the wellbore to connect with the outer body 31. In one embodiment, the retrieval tool includes threads for mating with threads 77 on the outer surface of the outer sleeve 51 of the outer body 31. A pull force is then applied to the retrieval tool to release the outer body 31 from the inner body 21. In one embodiment, the pull force is transmitted along the outer body 31 to the shear screws 78 connecting the outer body 31 to the inner body 21. The pull force is sufficient to shear the screws 78. The outer body 31, disconnected from the inner body 21 and the packer and anchor assembly 210, is retrieved to surface. After release of the outer body 31, fluid communication between the wellbore above and the wellbore below the packer and anchor assembly 210 is re-established via the bore of the inner body 21. Because the inner body 21 includes an inclined cut out 43, the inner body 21 can also serve to guide a downhole tool such as a drill bit, a mill bit, or a wellbore tubular such as a casing toward the window. Although the outer body 31 is described as being released after forming the window, it is contemplated the outer body 31 may be released at any suitable time, such as after the drill bit has extended the lateral wellbore or anytime fluid communication is to be re-established.

Figure 11:
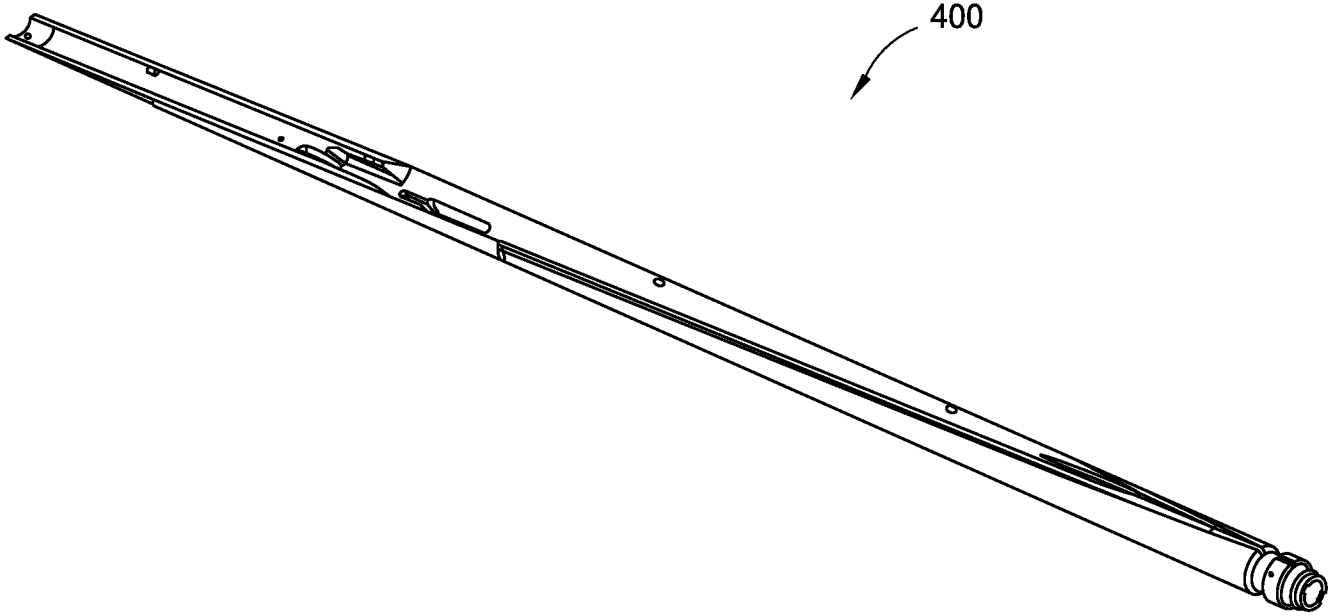
FIG. 11 is a perspective view of one embodiment of a whipstock for milling a window in a wellbore.
Figure 12:
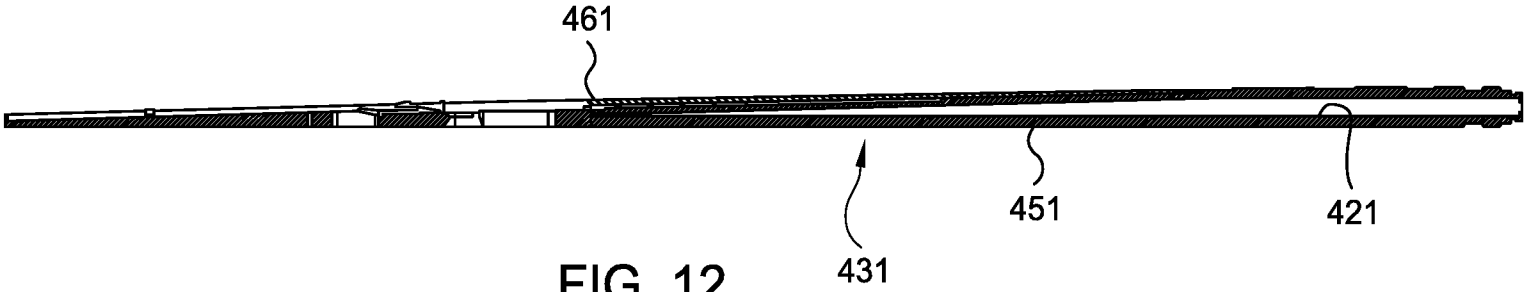
FIG. 12 is a cross-sectional view of the whipstock of FIG. 11.
Figure 12A:
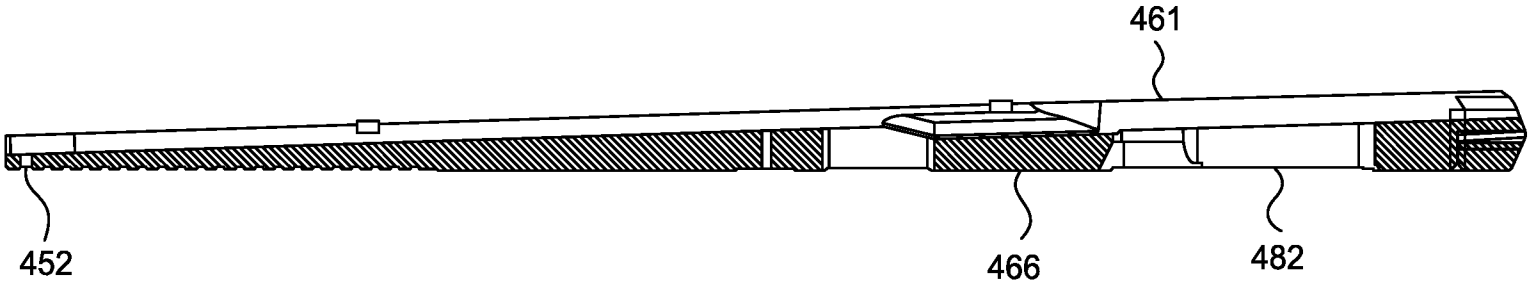
FIGS. 12A, 12B, and 12C are enlarged partial views of the whipstock of FIG. 12.
Figure 12B:
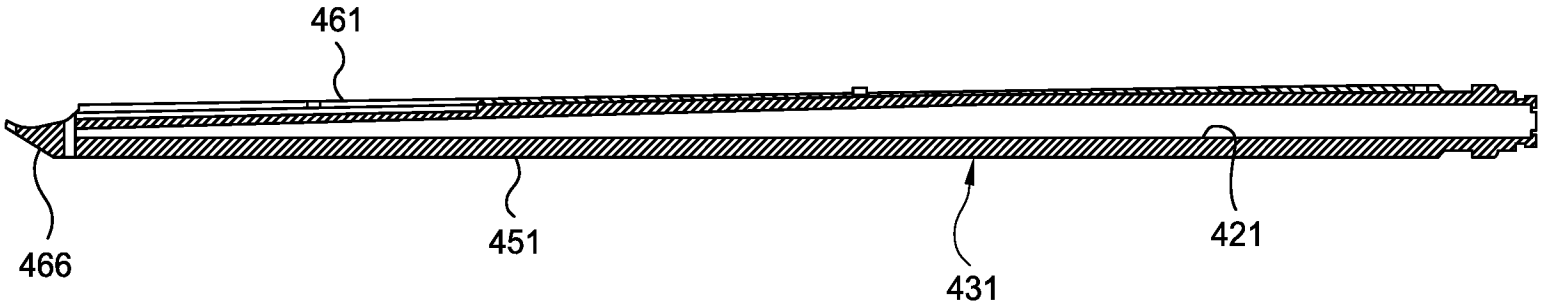
Figure 12C:
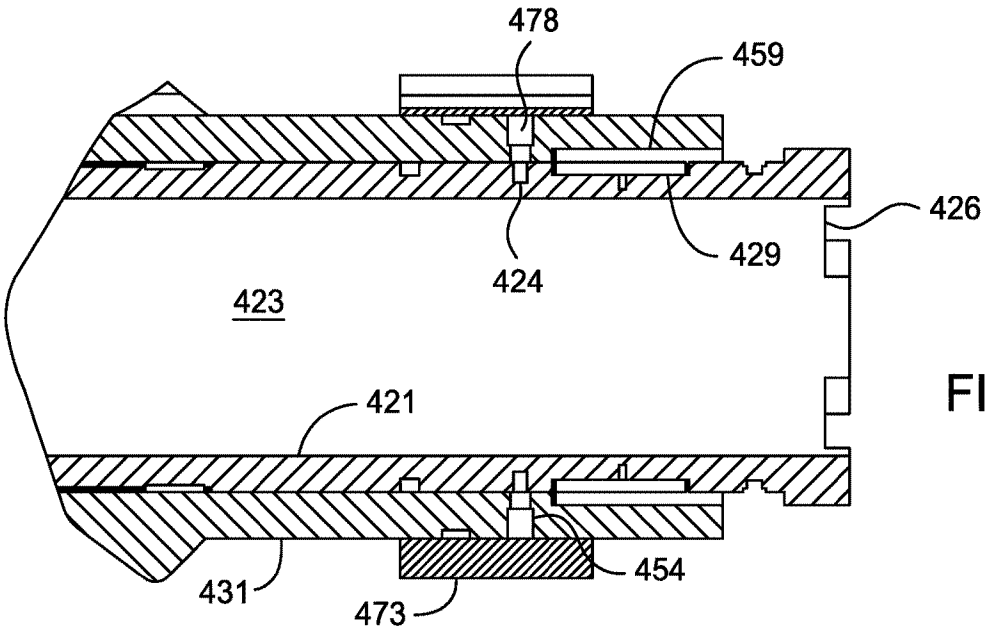
Figure 12F:
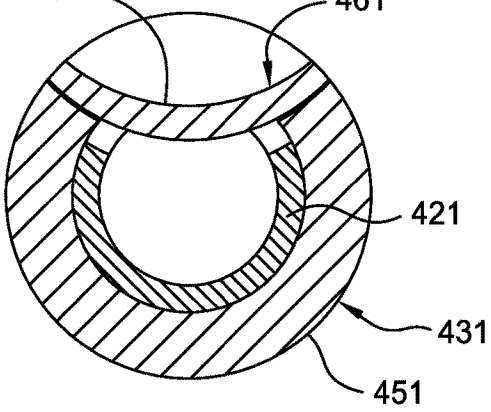
FIGS. 12D, 12E, and 12F are cross-sectional views of different axial sections of the whipstock of FIG. 12.
Figure 12E:
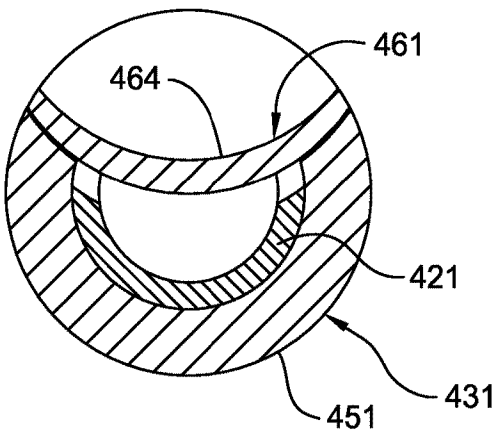
Figure 12D:
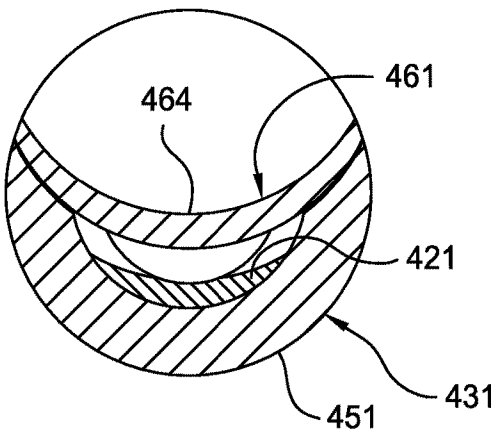

FIG. 11 is a perspective view of another embodiment of the whipstock 400 for milling a window in a wellbore. FIG. 12 is a cross-sectional view of the whipstock 400 of FIG. 11. FIGS. 12A, 12B, and 12C are enlarged partial cross-sectional views of the whipstock 400 of FIG. 12. FIGS. 12D, 12E, and 12F are cross-sectional views of different axial sections of the whipstock 400 of FIG. 12. The whipstock 400 is suitable for use with the packer and anchor assembly 210 of FIG. 1.

The whipstock 400 has a lower end for connecting to the packer and anchor assembly 210 and a concave shaped upper portion for guiding a drilling member such as a mill bit or a drill bit. In one embodiment, the whipstock 400 includes an outer sleeve body 431 disposed around an inner hollow body 421. As shown in FIG. 12C, the lower end of the outer body 431 is releasably attached to the inner body 421 using a shearable member 441 such as a shear screw. The lower end of the inner body 421 is coupled to the packer and anchor assembly 210 and configured to transfer torque to or from the packer and anchor assembly 210. As shown in FIG. 12B, the upper end of the inner body 421 is disposed within the outer body 431.

Figure 13:
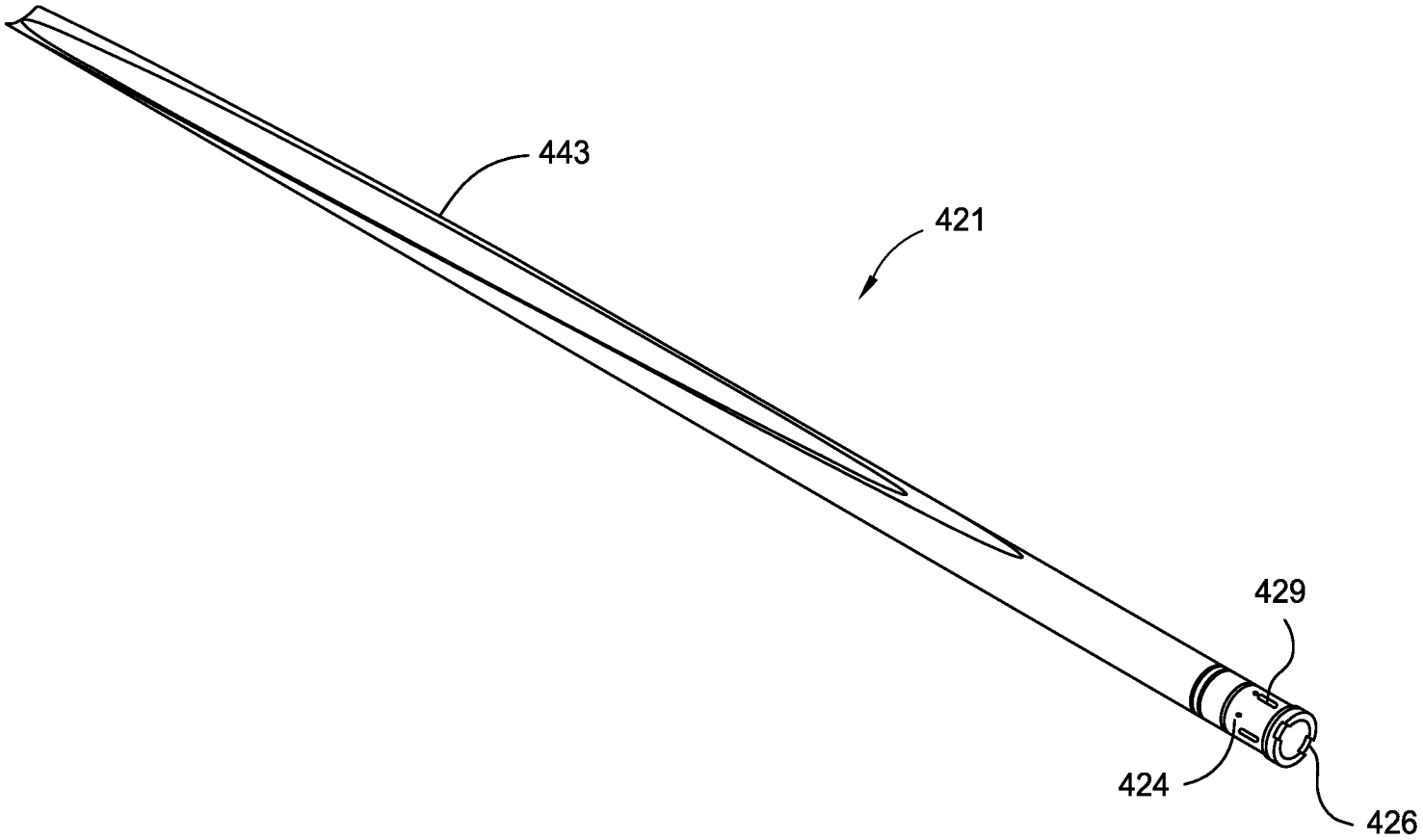
FIG. 13 illustrates a perspective view of an inner body of the whipstock of FIG. 11, in accordance with one embodiment.
Figure 13A:
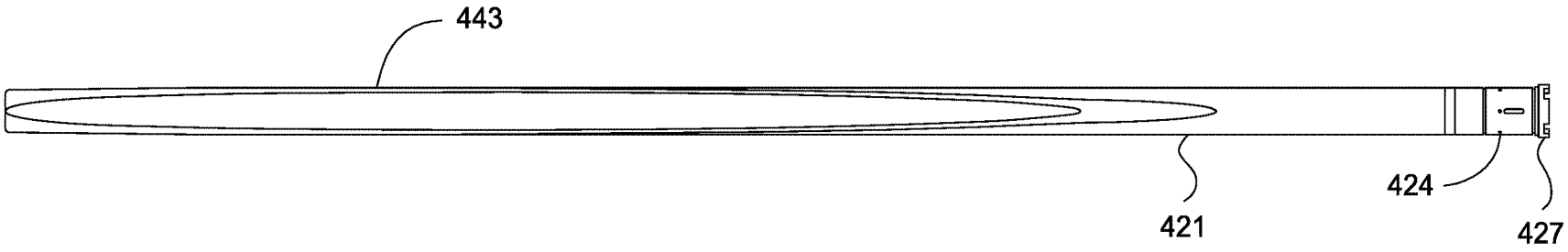
FIG. 13A is a top view of the inner body of the whipstock of FIG. 11.
Figure 13B:
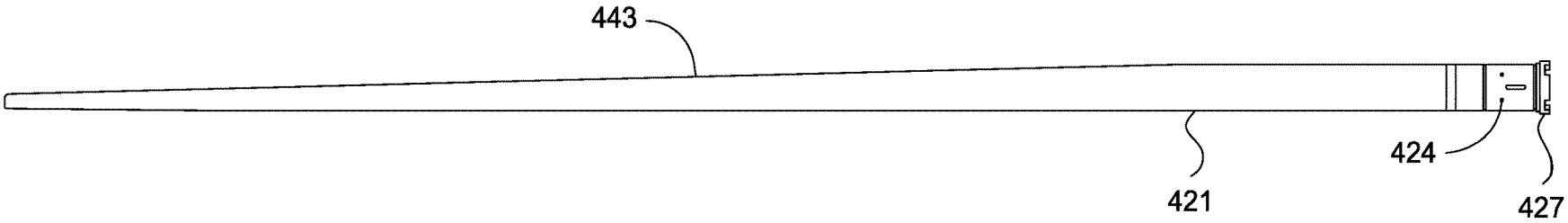
FIG. 13B is a side view of the inner body.
Figure 13C:
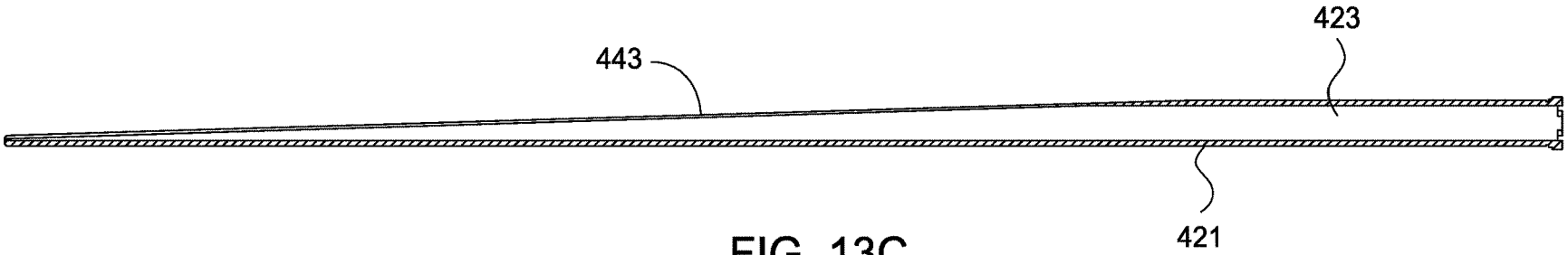
FIG. 13C is a cross-sectional view of the inner body.
Figure 14C:
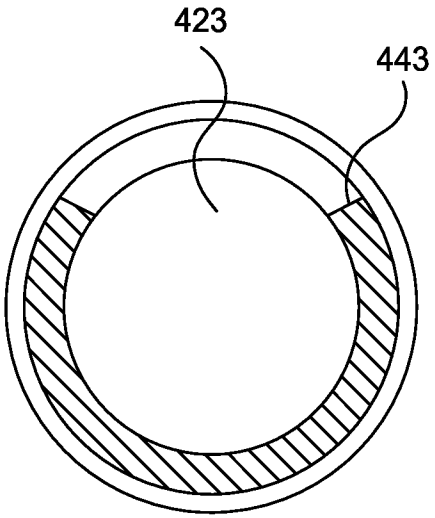
FIGS. 14A, 14B, and 14C are cross-sectional views of different axial sections of the inner body.
Figure 14B:
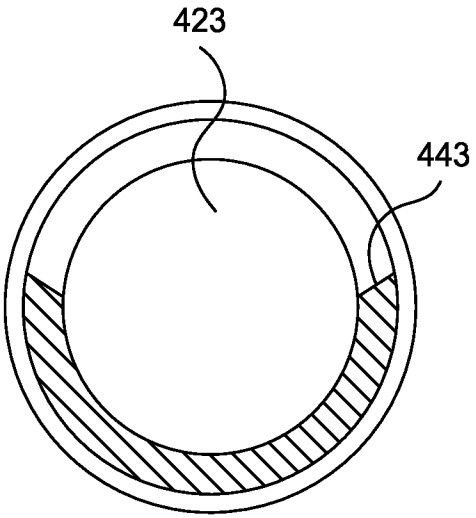
Figure 14A:
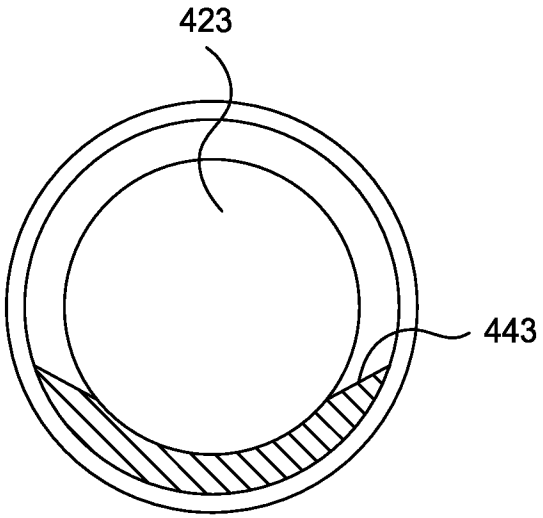

FIG. 13 illustrate a perspective view of the inner body 421 in accordance with one embodiment. FIG. 13A is a top view of the inner body 421, FIG. 13B is a side view of the inner body 421, and FIG. 13C is a cross-sectional view of the inner body 421. FIGS. 14A, 14B, and 14C are cross-sectional views of different axial sections of the inner body 421. In one embodiment, the inner body 421 is a tubular having a bore 423 extending therethrough. The upper portion of the inner body 421 has an inclined cut out 443 that exposes the bore 423. The inclined cut out 443 may be achieved using a concave cut on a wall of the inner body 421, as shown in FIGS. 14A-14C. The inclined cut out 443 may begin at the upper end of the inner body 421 and the inclined cut out 443 extending toward the lower end. In one embodiment, the inclined cut out 443 formed on the upper portion of the inner body 421 may be used as a ramp to guide the movement of the mill and set the mill's angle of attack to form the window. In one embodiment, the inclined cut out 443 is between about 2 degrees and 15 degrees; preferably between 2 degrees and 8 degrees; and more preferably between about 2 degrees and 5 degrees.

The lower end of the inner body 421 may include one or more holes 424 formed on the outer surface for receiving a shearable member, as shown in FIGS. 13A and 12C. While six holes 424 are shown, any suitable number of holes may be formed, such as one, two, three, four, five, seven, eight, or more holes. The bottom of the inner body 421 has an enlarged outer diameter such that a shoulder 427 is formed on the outer surface for engagement with a locking sleeve 215 of the packer and anchor assembly 210. The bottom surface of the inner body 421 may also have one or more lug slots 426 for engagement with torque lugs of the packer and anchor assembly 210. A plurality of lug slots 426 may be circumferentially spaced around the bottom of the inner body 421. The inner body 421 may include an optional alignment slot 429 for retaining a guide member, such as a key, for alignment with the outer body 431, as shown in FIG. 12C.

Figure 15B:
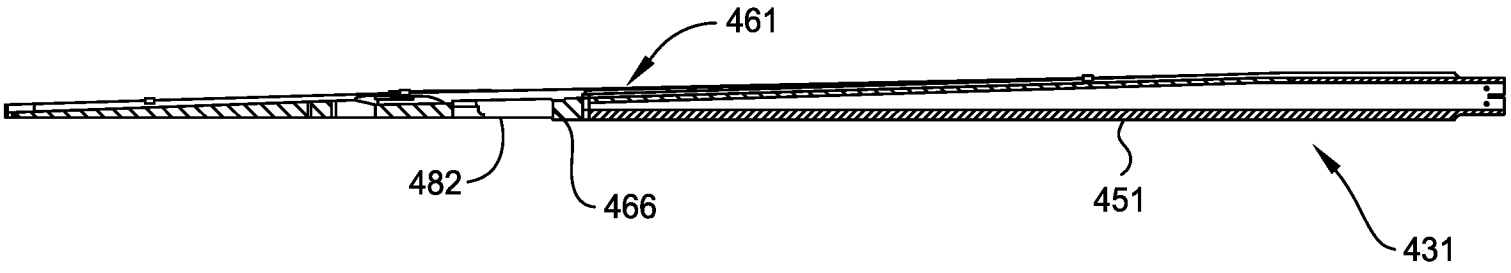
FIG. 15B is a cross-sectional view of FIG. 15A.
Figure 15A:
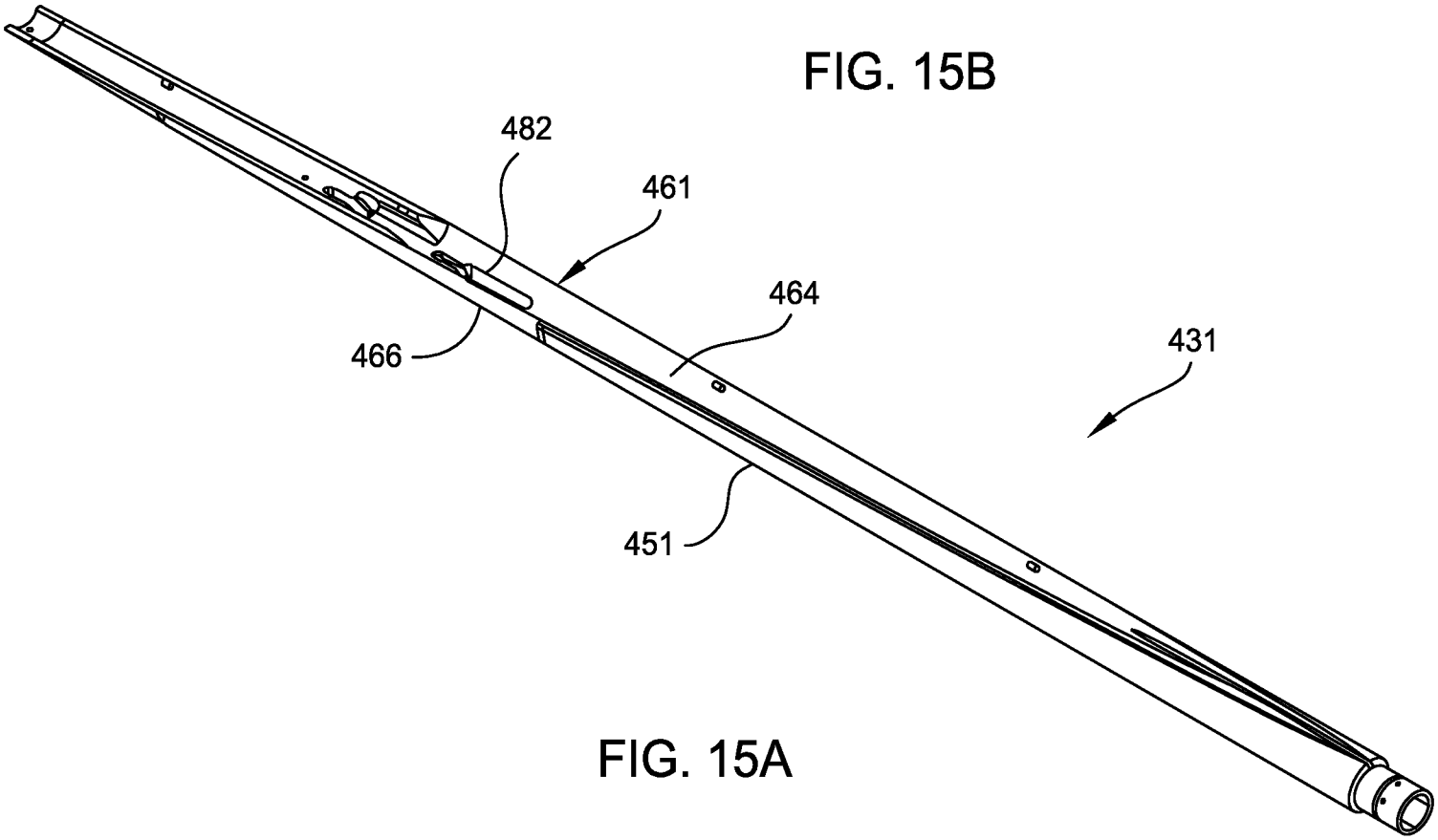
FIG. 15A is a perspective view of the outer body of the whipstock of FIG. 11, according to one embodiment.
Figures 16A, 16B, 16C, 16D:
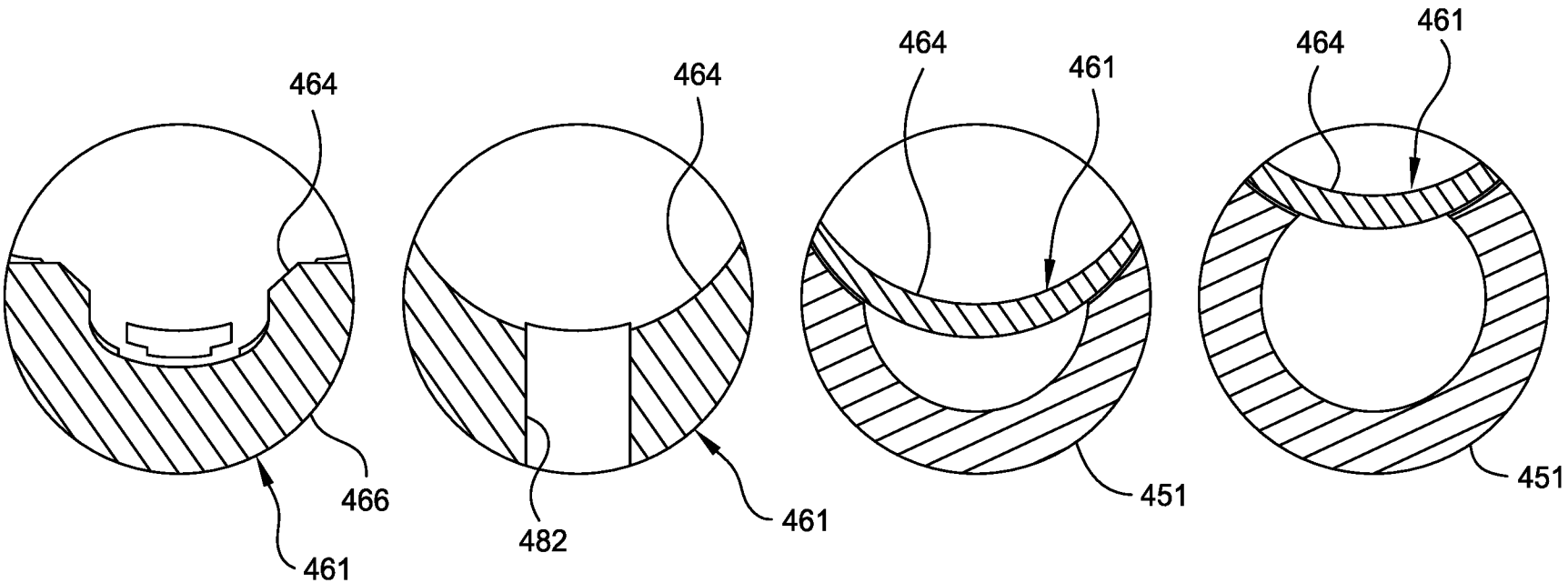
FIGS. 16A-16D are different cross-sectional views of the outer body of FIG. 15A.
Figure 17B:
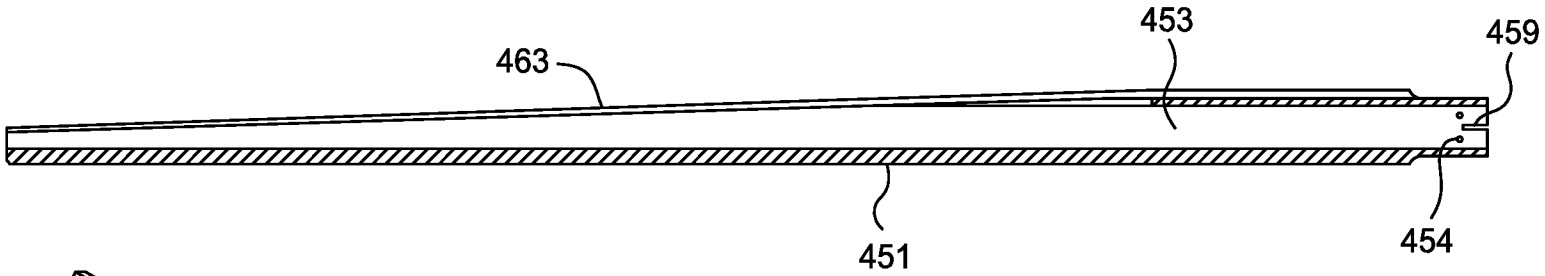
FIG. 17B is a cross-sectional view of FIG. 17A.
Figure 17A:
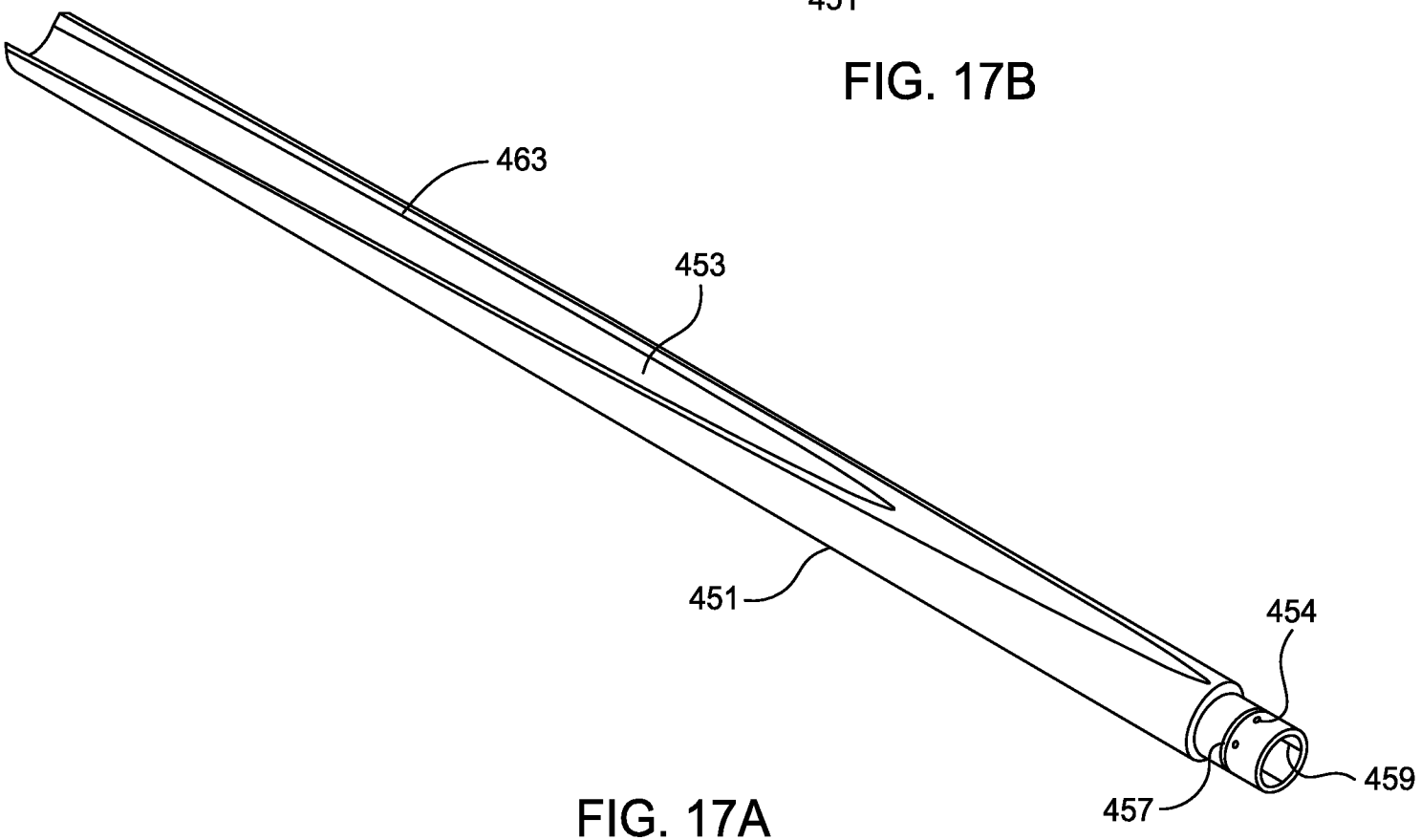
FIG. 17A is a perspective view of the outer sleeve of the outer body of FIG. 15A.
Figure 17D:
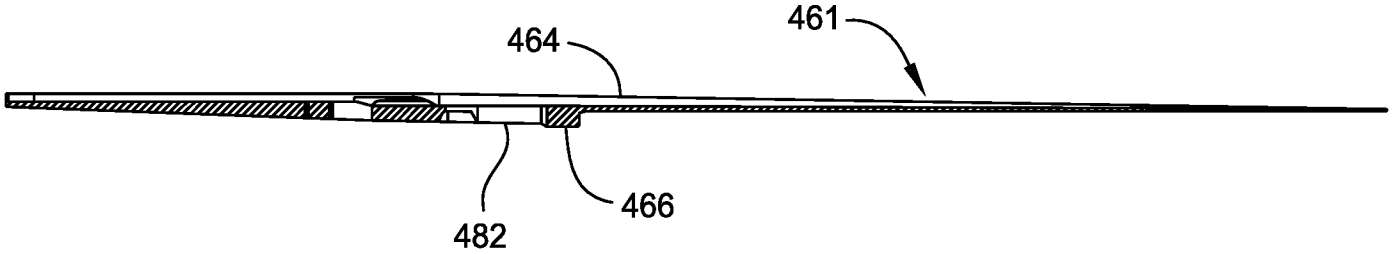
FIG. 17D is a cross-sectional view of FIG. 17C.
Figure 17C:
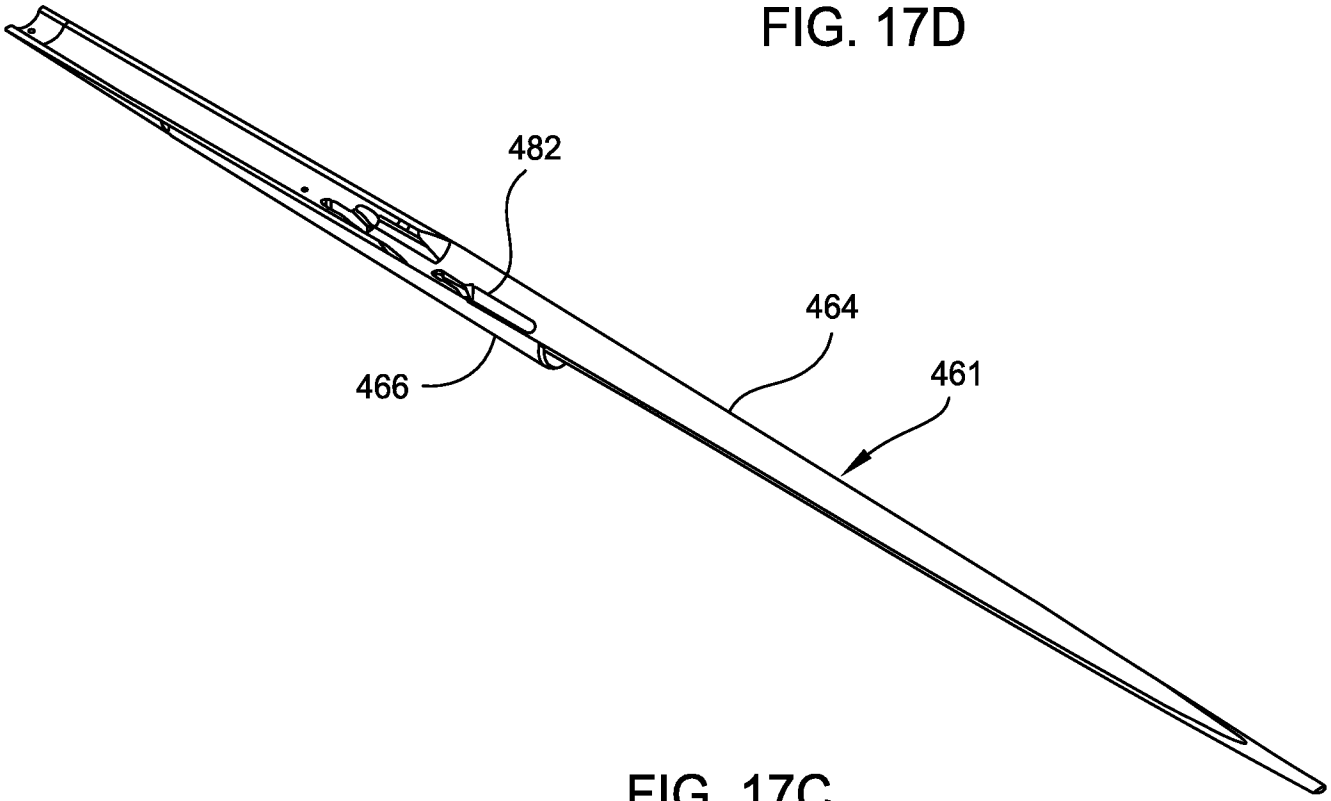
FIG. 17C is a perspective view of the concave member of the outer body of FIG. 15A.

As shown in FIGS. 12B and 12C, the inner body 421 is received in the outer body 431. FIG. 15A is a perspective view of the outer body 431, according to one embodiment, and FIG. 15B is a cross-sectional view of FIG. 15A. FIGS. 16A-16D are different cross-sectional views of the outer body of FIG. 15A. In one embodiment, the outer body 431 includes an outer sleeve 451 and a concave member 461. FIG. 17A is a perspective view of the outer sleeve 451 of the outer body 431, and FIG. 17B is a cross-sectional view of FIG. 17A. FIG. 17C is a perspective view of the concave member 461 of the outer body 431, and FIG. 17D is a cross-sectional view of FIG. 17C. While the outer body 431 is shown as an assembly of the outer sleeve and the concave member, it is contemplate that one of more of these components may be integral to each other.

In one embodiment, the outer sleeve 451 of the outer body 431 is a tubular having a bore 453 extending therethrough. The upper portion of the outer sleeve 451 has an inclined cut out 463 that exposes the bore 453. The inclined cut out 463 may be achieved using a concave cut, similar to the inner body 421. The inclined cut out 463 begins at the upper end of the outer sleeve 451 and increases toward the lower end. The inclined cut out 463 may be used to guide the movement of the mill and set the mill's angle of attack to form the window. In one embodiment, the angle of inclined cut out 463 of the outer sleeve 451 is the same as the angle of the inclined cut out 443 of the inner body 421. In one embodiment, the inclined cut out 463 is between about 2 degrees and 15 degrees; preferably between 2 degrees and 8 degrees; and more preferably between about 2 degrees and 5 degrees. The lower end of the outer sleeve 451 may include one or more holes 454 that can be aligned with the holes 424 of the inner body 421 for receiving a shearable member such as a shear screw. An optional retaining sleeve 473 may be disposed around holes 454 to prevent the shearable members in the holes from falling out or retain the caps of the shearable members after shearing, as shown in FIG. 12C. The retaining sleeve 473 may be attached to the outer sleeve 451 using one or more set screws 474 that engage a circular groove 457 formed on the outer surface of the outer sleeve 451. The outer body 431 may include an optional alignment slot 459 formed on its inner surface for retaining a guide member for alignment with the alignment slot 429 of the inner body 431, as shown in FIG. 12C.

The concave member 461 is disposed above and attached to the inclined cut out 463 of the outer sleeve 451. The concave member 461 includes a concave surface 464 forming a ramp to guide the path of the mill bit. The upper portion of the concave member 461 may include a connection 452 for connecting to a work string and/or a mill bit or drill bit.

The connection 452 may include a hole for receiving a shearable member such as a shear screw. In one embodiment, the upper portion of the concave member 461 includes a support body 466 for supporting the upper portion in a wellbore. In this embodiment, the support body 466 is integral with the concave surface 464. A retrieval slot 482 is formed in the upper portion for retrieving the outer body 431. The concave member 461 attaches to and extends along the length of the inclined cut out 463 of the outer sleeve 451, and its width is tapered to complement the inclined cut out 463. The upper end of the outer sleeve 451 attaches to the lower end of the support body 466. As shown in FIG. 17C, the width of the concave member 461 narrows towards the lower end to complement the inclined cut out 463. As shown in FIGS. 17D, 16C, and 16D, the curvature of the concave member 461 is deeper at the upper end and gradually becomes shallower at the lower end. The concave cut used to form the inclined cut out 463 of the outer sleeve 451 is complementary to the back surface of the concave member 461, as shown in FIGS. 16C and 16D. In one embodiment, the concave member 461 prevents fluid communication through the upper end of the outer body 431. In one embodiment, the concave member 461 is welded to the outer sleeve 451.

In another embodiment, a concave member may be disposed on the inclined cut out of the inner body 421. In this embodiment, the concave member includes one or more openings to allow fluid communication through the concave member.

In FIG. 12, the inner body 421 is disposed inside the outer body 431. In FIG. 12C, a plurality of shearable members 478 such as a shear screw are disposed through the holes 424 of the inner body 421 and the holes 454 of the outer sleeve 451. The retaining sleeve 473 covers the shearable members 478 and is coupled to the outer sleeve 451 using a plurality of set screws 475.

FIG. 12A shows the upper portion of the concave member 461. FIG. 12B shows the inner body 421 disposed in the outer body 431. The upper end of the inner body 421 is disposed between the concave member 461 and the outer sleeve 451. FIGS. 12B-12D are cross-sectional views of the inner body 421 inside the outer body 431 along progressively lower, axial sections of the concave surface 464. FIG. 12B is a cross-sectional view of the upper portion of the inner body 421 disposed inside the outer body 431. FIG. 12D is a cross-sectional view of a lower portion of the inner body 421 disposed inside the outer body 421. It can be seen FIG. 12D is a view of a section of the inclined cut out 463 because the bore 453 is partially obstructed by the concave member 461.

While the whipstock 400 is suitable for use with the packer and anchor assembly 210, it is contemplated embodiments of the whipstock 400 may be used with any suitable packer, anchor, or a combination of packer and anchor assembly. For example, the anchor may include a plurality of slips disposed on a mandrel having a bore. The packer may include a sealing element disposed on a mandrel having a bore.

In operation, whipstock 400 is assembled with the packer and anchor assembly 210. A mill is attached to the upper end of the whipstock 400 such as via the connection 452 of the outer body 431. For example, the mill can be releasably attached to the connection using a shearable lug or screw. The whipstock 400 is lowered into the wellbore using a workstring. After reaching the location of the window to be formed, the packer and anchor assembly 210 is set below the window. After supplying hydraulic fluid to set the slips 235, weight is set down on the whipstock 400, thereby compressing the sealing element 230 between the shoulder of the mandrel 211 and the upper wedge member 241. The sealing element 230 is urged outwardly into engagement with the surrounding casing to seal off fluid communication through the annulus. Although the bore of the inner body 421 is open to fluid pressure from below the sealing element 230, the outer body 431 closes communication through the bore of the inner body 421.

Additional pressure is applied to the mill to release the mill from the whipstock 400. For example, sufficient pressure is applied from the surface to break the shearable lug or screw connecting the mill to the whipstock 400. The mill is then urged along the concave member 461 of the whipstock 400, which deflects the mill outward into engagement with the casing.

After the window is formed, the mill is retrieved. A retrieval tool is lowered into the wellbore to connect with the outer body 431. In one embodiment, the retrieval tool engages the retrieval slot 482 of the outer body 431. A pull force is then applied to the retrieval tool to release the outer body 431 from the inner body 421. In one embodiment, the pull force is transmitted along the outer body 431 to the shear screws 478 connecting the outer body 431 to the inner body 421. The pull force is sufficient to shear the screws 478. After release of the outer body 431, fluid communication between the wellbore above and the wellbore below the packer and anchor assembly 210 is re-established via the bore of the inner body 421. Because the inner body 421 includes an inclined cut out 443, the inner body 421 can also serve to guide a downhole tool such as a drill bit, a mill bit, or a wellbore tubular such as casing toward the window. Although the outer body 431 is described as being released after forming the window, it is contemplated the outer body 431 may be released at any suitable time, such as after the drill bit has extended the lateral wellbore or anytime fluid communication is to be re-established.

Figure 8:
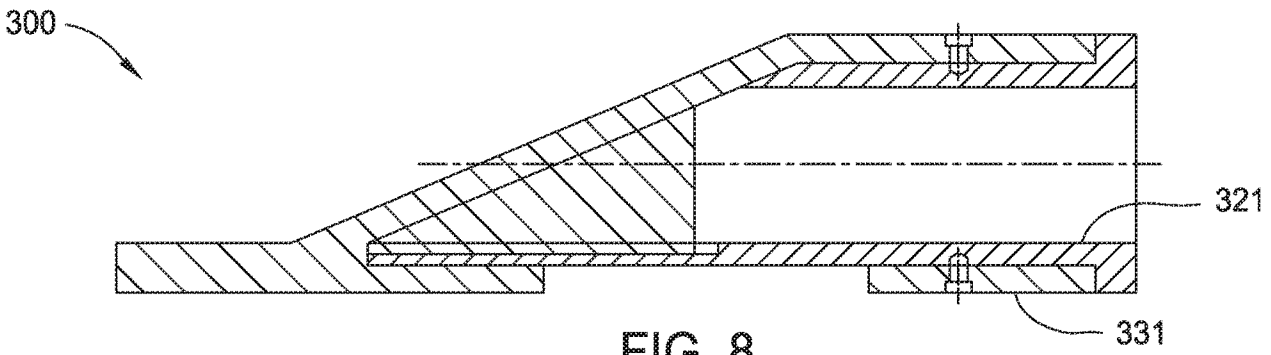
FIG. 8 is a cross-sectional view of another embodiment of the whipstock assembly.
Figure 9:
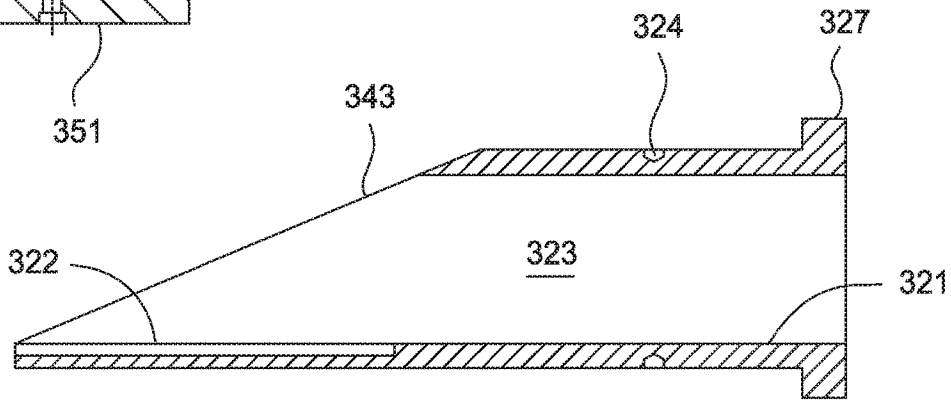
FIG. 9 is an enlarged cross-sectional view of the inner body of the whipstock of FIG. 8.

FIG. 8 is a cross-sectional view of another embodiment of the whipstock assembly 300 for milling a window in a wellbore. For sake of clarity, many features of the whipstock 300 that are similar to the whipstock 100 of FIG. 2 are not discussed again in detail or shown in the following Figures. In FIG. 9, the whipstock 300 is shown without being attached to a packer and anchor assembly.

Figure 10:
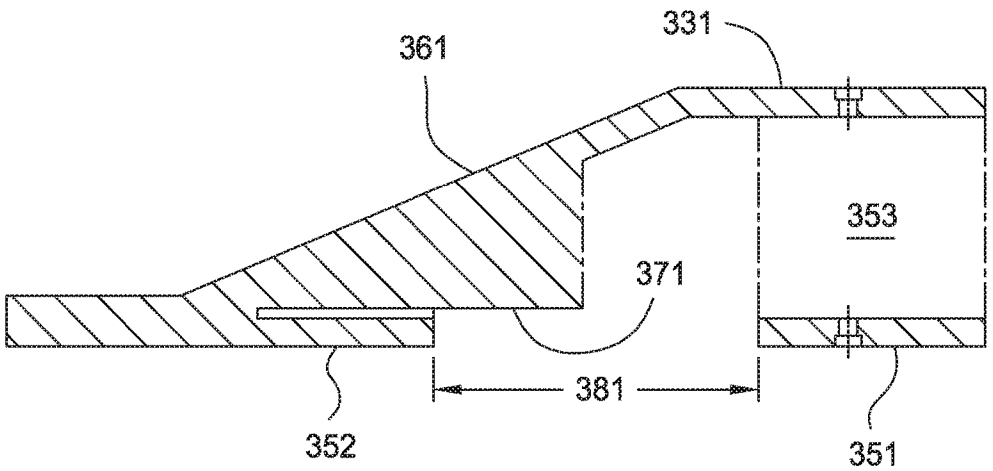
FIG. 10 is a cross-sectional view of the outer body of the whipstock of FIG. 8.

The whipstock 300 has a lower end for connecting to the packer and anchor assembly and a concave shaped upper portion for guiding a mill or a drill bit. In one embodiment, the whipstock 300 includes an inner hollow body 321 disposed in an outer body 331. FIG. 9 is an enlarged cross-sectional view of the inner body 321. FIG. 10 is a cross-sectional view of the outer body 331. The lower end of the outer body 331 may be releasably attached to the inner body 321 using a shearable member such as a shear screw. The lower end of the inner body 321 is coupled to the packer and anchor assembly and configured to transfer torque to or from the packer and anchor assembly. As shown in FIG. 8, the upper end of the inner body 321 is disposed within the upper end of the outer body 331.

FIG. 9 illustrate a cross-sectional view of an embodiment of the inner body 321. In one embodiment, the inner body 321 is a tubular having a bore 323 extending therethrough. The upper portion of the inner body 321 has an inclined cut out 343 that exposes the bore 323. The inclined cut out 343 may be achieved using a concave cut on a wall of the inner body 321. The inclined cut out 343 may begin at the upper end of the inner body 321 and extend toward the lower end. In one embodiment, the inclined cut out 343 formed on the upper portion of the inner body 321 may be used as a ramp to guide the movement of the mill and set the mill's angle of attack to form the window. In one embodiment, the inclined cut out 343 is between about 2 degrees and 15 degrees; preferably between 2 degrees and 8 degrees; and more preferably between about 2 degrees and 5 degrees.

As shown in FIG. 9, an optional slot 322 may be formed on an inner surface of the inner body 321 to receive a key from the outer body 331. The slot 322 is a longitudinal slot that facilitates alignment of the inner body 321 to the outer body 331 and may also prevent relative rotation between the inner body 321 and the outer body 331. In one embodiment, the slot 322 begins at the upper end of the inner body 321. The slot 322 may be between about 75% to 125% of the length of the inclined cut out 343. In another embodiment, the slot 322 is between about 5% to 125% of the length of the inclined cut out 343; preferably between about 10% to 80% of the length of the inclined cut out 343; preferably between about 15% to 65% of the length of the inclined cut out 343. The slot 322 may be longer than the length of the key. The lower end of the inner body 321 may include one or more holes 324 formed on the outer surface for receiving a shearable member. While six holes 324 are shown, any suitable number of holes 324 may be formed, such as one, two, three, four, five, seven, eight, or more holes. The bottom of the inner body 321 has an enlarged outer diameter such that a shoulder 327 is formed on the outer surface. The shoulder 327 may be used to engage a locking sleeve or other attachment mechanisms of the packer and anchor assembly.

As shown in FIG. 8, the inner body 321 is received in the outer body 331. FIG. 10 is a cross-sectional view of the outer body 331, according to one embodiment. In one embodiment, the outer body 331 includes a lower outer sleeve 351, an upper outer sleeve 352, a concave member 361, and a guide key 371. While the outer sleeves, the concave member, and the key are shown integrated with each other, it is contemplate that one of more of these components may be assembled to each other.

In one embodiment, the lower outer sleeve 351 of the outer body 331 is a tubular having a bore 353 extending therethrough. The lower outer sleeve 351 may be disposed around the inner body 321 and attached thereto using a one or more sharable members. As shown in FIG. 8, the lower outer sleeve 351 does not extend along the entire length of the inner body 321.

The concave member 361 is attached to the lower outer sleeve 351 and disposed over the inclined cut out of the inner body 321. The concave member 361 may have a concave cut on its sides, similar to the inner body 321. The concave member 361 may be used to guide the movement of the mill and set the mill's angle of attack to form the window. The concave member 361 forms a protective ramp over the inclined cut out 343. In one embodiment, the concave member 361 extends along the length of the inclined cut out 343, and its width is tapered to complement the inclined cut out 343. In one embodiment, the concave member 361 prevents or substantially prevents fluid communication through the upper end of the outer body 331.

The upper outer sleeve 352 is attached to the upper end of the concave member 361. The upper outer sleeve 352 has an inclined cut out that attaches to the concave member 361. The inclined cut out may be achieved using a concave cut, similar to the inner body 321. The inclined cut out may begin near the upper end of the outer sleeve 352 and extends toward the lower end. In one embodiment, the angle of inclined cut out of the upper outer sleeve 352 is the same as the angle of the inclined cut out 343 of the inner body 321. In one embodiment, the inclined cut out is between about 2 degrees and 15 degrees; preferably between 2 degrees and 8 degrees; and more preferably between about 2 degrees and 5 degrees. The upper end of the upper outer sleeve 352 may include a connection for connecting to a work string and/or a mill bit or drill bit. The connection may include a hole for receiving a shearable member such as a shear screw. The lower end of the outer In one embodiment, the outer body 331 includes a guide member 371 such as a guide key to facilitate alignment of the inner body 321 to the outer body 331. The guide key 371 has an inclined top surface that attaches to the bottom surface of the concave member 361. The guide key 371 has a bottom surface for mating with the slot 322 of the inner body 321. In one embodiment, the guide member 371 aligns the inner body 321 to the outer body 331 so that the inclined surface of the inner body 321 directs the downhole tool toward the window formed by the mill bit moving along the inclined surface of the outer body 331. A sufficient clearance is formed between the bottom surface 372 of the guide key 371 and the inner surface of the upper outer sleeve 352 to receive the inner body 321 and the slot 322. The clearance at the bottom of the guide key 371 can be seen in FIG. 10. In one embodiment, the upper outer sleeve 352 partially encircles the upper end of the inner body 321. A gap 381 exists between the end of the upper outer sleeve 352 and the end of the lower outer sleeve 351.

As seen in FIG. 8, the inner body 321 is disposed in the outer body 331. The upper end is disposed between the concave member 361 and the upper outer sleeve 352. The key 371 is in the slot 322 of the inner body 321. The lower outer sleeve of the outer body 351 is attached to the inner body 321 using shearable member such as a shear screw.

In operation, whipstock 300 is assembled with the packer and anchor assembly, such as the packer and anchor assembly 210 in FIG. 2A. A mill is attached to the upper end of the whipstock 300 such as via the connection of the outer body 331. For example, the mill can be releasably attached to the connection using a shearable lug or screw. The whipstock 300 is lowered into the wellbore using a workstring. After reaching the location of the window to be formed, the packer and anchor assembly 310 is set below the window. For example, the slips may be set hydraulically, and the packer may be set mechanically. Although the bore of the inner body 321 is open to fluid pressure from below the packer, the outer body 331 closes communication through the bore of the inner body 321.

Additional pressure is applied to the mill to release the mill from the whipstock. For example, sufficient pressure is applied from the surface to break the shearable lug or screw connecting the mill to the whipstock. The mill is then urged along the concave member 361 of the whipstock 300, which deflects the mill outward into engagement with the casing.

After the window is formed, the mill is retrieved. A retrieval tool is lowered into the wellbore to connect with the outer body 331. In one embodiment, the retrieval tool includes threads for mating with threads 377 on the outer surface of the upper outer sleeve 352 of the outer body 331. A pull force is then applied to the retrieval tool to release the outer body 331 from the inner body 321. In one embodiment, the pull force is transmitted along the outer body 331 to the shear screws 3 connecting the lower outer sleeve 351 to the inner body 321. The pull force is sufficient to shear the screws. The outer body 331, disconnected from the inner body 321 and the packer and anchor assembly, is retrieved to surface. After release of the outer body 331, fluid communication between the wellbore above and the wellbore below the packer and anchor assembly is re-established via the bore of the inner body 321. The inclined cut out 343 of the inner body is protected from the mill by the concave member 361 of the outer body 331. The inclined cut out 343 of the inner body 321 can serve to guide a downhole tool such as a drill bit, a mill bit, or a wellbore tubular such as casing toward the window. Although the outer body 331 is described as being released after forming the window, it is contemplated the outer body 331 may be released at any suitable time, such as after the drill bit has extended the lateral wellbore or anytime fluid communication is to be re-established.

A whipstock assembly includes an inner body having a bore and an inclined surface at an upper portion; and an outer body disposed around the inner body and releasably attached to the inner body, the outer body having an inclined surface and an upper portion closed to fluid communication.

In one or more of the embodiments described herein, the outer body is releasably attached to the inner body using a shearable member.

In one or more of the embodiments described herein, the inclined surface of the inner body has a concave cut on a wall of the inner body.

In one or more of the embodiments described herein, at least a portion of the inclined surface of the outer body is disposed above the inclined surface of the inner body.

In one or more of the embodiments described herein, the whipstock includes a guide member for coupling the outer body to the inner body.

In one or more of the embodiments described herein, the guide member mates with a slot formed in the inner body.

In one or more of the embodiments described herein, the guide member is attached to the inclined surface of the outer body.

In one or more of the embodiments described herein, a clearance is formed between the guide member and an outer sleeve of the outer body to at least partially receive the inner body.

In one embodiment, a method for forming a window in a wellbore includes lowering a work string having a drilling member, a whipstock assembly, a sealing element, and an anchor, wherein the whipstock assembly includes an outer body releasably attached to an inner body; setting the sealing element and the anchor; releasing the drilling member from the whipstock assembly; moving the drilling member along an inclined surface of the outer body to form the window; releasing the outer body from the inner body; and moving a downhole tool along an inclined surface of the inner body.

In one or more of the embodiments described herein, the method includes retrieving the outer body after release from the inner body.

In one or more of the embodiments described herein, releasing the outer body comprises applying a sufficient pull force to the outer body to release the outer body from the inner body.

In one or more of the embodiments described herein, releasing the outer body further comprises attaching a retrieval tool to the outer body and applying the pull force via the retrieval tool.

In one or more of the embodiments described herein, setting the anchor comprises supplying a hydraulic fluid.

In one or more of the embodiments described herein, setting the sealing element comprises applying compressive force to the sealing element.

In one or more of the embodiments described herein, fluid communication through the whipstock assembly is prevented when the outer body is attached to the inner body.

In one or more of the embodiments described herein, fluid communication in the wellbore across the whipstock assembly and the sealing element is prevented after setting the sealing element.

In one or more of the embodiments described herein, fluid communication in the wellbore across the whipstock assembly is allowed after releasing the outer body from the inner body.

In one embodiment, a downhole tool for use in forming a lateral wellbore includes a whipstock assembly having an inner body having a bore and an inclined surface at an upper portion; and an outer body disposed around the inner body and releasably attached to the inner body, the outer body having an inclined surface. The downhole tool also includes a sealing element coupled to the whipstock assembly; and an anchor coupled to the whipstock assembly, the anchor having a bore in fluid communication with the bore of the inner body.

In one or more of the embodiments described herein, the inclined surface of the inner body is aligned with inclined surface of the outer body.

In one or more of the embodiments described herein, the inclined surfaces are aligned by mating a guide member to a slot.

While the foregoing is directed to embodiments of the present disclosure, other and further embodiments of the disclosure may be devised without departing from the basic scope thereof, and the scope thereof is determined by the claims that follow.

The invention claimed is:

1. A whipstock assembly, comprising:

an inner body having a bore and an inclined surface at an upper portion; and an outer body disposed around the inner body and releasably attached to the inner body, the outer body including an outer sleeve having a through bore, the outer sleeve including:

an inclined surface formed by an inclined cut of a tubular wall of the outer sleeve; and a concave member disposed on the inclined surface and closes fluid communication through the through bore of the outer sleeve, wherein an upper portion of the outer body closes fluid communication through the bore of the inner body.

2. The whipstock assembly of claim 1, wherein the outer body is releasably attached to the inner body using a shearable member.

3. The whipstock assembly of claim 1, wherein the inclined surface of the inner body has a concave cut on a wall of the inner body.

4. The whipstock assembly of claim 1, wherein at least a portion of the inclined surface of the outer body is disposed above the inclined surface of the inner body.

5. The whipstock assembly of claim 1, further comprising a guide member for coupling the outer body to the inner body.

6. The whipstock assembly of claim 5, wherein the guide member mates with a slot formed in the inner body.

7. The whipstock assembly of claim 5, wherein the guide member is attached to the inclined surface of the outer body.

8. The whipstock assembly of claim 5, further comprising a clearance formed between the guide member and an outer sleeve of the outer body to at least partially receive the inner body.

9. A method for forming a window in a wellbore, comprising:

lowering a work string having a drilling member, a whipstock assembly, a sealing element, and an anchor, wherein the whipstock assembly includes an outer body located around and releasably attached to an inner body having a bore such that the outer body closes fluid flow through the bore, wherein the outer body includes an outer sleeve having an inclined surface formed by an inclined cut of a wall of the outer sleeve and a concave member disposed on the inclined surface, the concave member closing fluid communication through a through bore of the outer sleeve;

setting the sealing element and the anchor;

releasing the drilling member from the whipstock assembly;

moving the drilling member along the inclined surface of the outer body to form the window;

releasing the outer body from the inner body so as to allow fluid flow through the bore of the inner body; and moving a downhole tool along an inclined surface of the inner body.

10. The method of claim 9, further comprising retrieving the outer body after release from the inner body.

11. The method of claim 9, wherein releasing the outer body comprises applying a sufficient pull force to the outer body to release the outer body from the inner body.

12. The method of claim 11, wherein releasing the outer body further comprises attaching a retrieval tool to the outer body and applying the pull force via the retrieval tool.

13. The method of claim 9, wherein setting the anchor comprises supplying a hydraulic fluid.

14. The method of claim 9, wherein setting the sealing element comprises applying compressive force to the sealing element.

15. The method of claim 9, wherein fluid communication through the whipstock assembly is prevented when the outer body is attached to the inner body.

16. The method of claim 9, wherein fluid communication in the wellbore across the whipstock assembly and the sealing element is prevented after setting the sealing element.

17. The method of claim 16, wherein fluid communication in the wellbore across the whipstock assembly is allowed after releasing the outer body from the inner body.

18. A downhole tool for use in forming a lateral wellbore, comprising:

a whipstock assembly, having:

an inner body having a bore and an inclined surface at an upper portion; and an outer body disposed around the inner body and releasably attached to the inner body, the outer body includes an outer sleeve having an inclined surface formed by an inclined cut of a wall of the outer sleeve and a concave member disposed on the inclined surface, wherein the concave member closes fluid communication through a through bore of the outer sleeve and the outer body closes fluid communication through the bore of the inner body;

a sealing element coupled to the whipstock assembly; and an anchor coupled to the whipstock assembly, the anchor having a bore in fluid communication with the bore of the inner body.

19. The downhole tool of claim 18, wherein the inclined surface of the inner body is aligned with inclined surface of the outer body.

20. The downhole tool of claim 19, wherein the inclined surfaces are aligned by mating a guide member to a slot.

21. The downhole tool of claim 18, wherein the inclined surface of the inner body includes a cut-out that exposes the bore.

* * * * *